US011130333B2

(12) United States Patent
Tanaka et al.

(10) Patent No.: US 11,130,333 B2
(45) Date of Patent: Sep. 28, 2021

(54) INKJET HEAD AND INKJET RECORDING APPARATUS

(71) Applicant: KONICA MINOLTA, INC., Tokyo (JP)

(72) Inventors: Souichi Tanaka, Machida (JP); Hikaru Hamano, Saitama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/958,916

(22) PCT Filed: Dec. 28, 2017

(86) PCT No.: PCT/JP2017/047168
§ 371 (c)(1),
(2) Date: Jun. 29, 2020

(87) PCT Pub. No.: WO2019/130532
PCT Pub. Date: Jul. 4, 2019

(65) Prior Publication Data

US 2020/0338891 A1 Oct. 29, 2020

(51) Int. Cl.
*B41J 2/14* (2006.01)
*B41J 2/045* (2006.01)
(Continued)

(52) U.S. Cl.
CPC ..... *B41J 2/14201* (2013.01); *B41J 2/04581* (2013.01); *B41J 2/155* (2013.01);
(Continued)

(58) Field of Classification Search
CPC ..... B41J 2202/12; B41J 2/1433; B41J 2/18; B41J 2202/21; B41J 2/175; B41J 2/14201;
(Continued)

(56) References Cited

U.S. PATENT DOCUMENTS 7,971,981 B2 * 7/2011 Nagashima ..... B41J 2/175 347/89
8,534,807 B2 * 9/2013 Hoisington ..... B41J 2/14 347/84
2016/0288498 A1 * 10/2016 Hayashi ..... B41J 2/1433

FOREIGN PATENT DOCUMENTS

JP 2008149579 A 7/2008

OTHER PUBLICATIONS

International Search Report for International Application No. PCT/JP2017/047168; dated Jun. 2, 2018.
(Continued)

*Primary Examiner* — Jannelle M Lebron
(74) *Attorney, Agent, or Firm* — Cantor Colburn LLP

(57) ABSTRACT

Provided is an inkjet head including: ink discharge sections with pressure chambers, nozzles, and first individual ink ejection flow paths and second individual ink ejection flow paths; a first common ink ejection flow path which communicates to the first individual ink ejection flow paths and into which ink flows through the first individual ink ejection flow paths in a first flow-in section; and a second common ink ejection flow path which communicates to the second individual ink ejection flow paths and into which ink flows through the second individual ink ejection flow paths in a second flow-in section. As a position of the nozzles is nearer to a one end, corresponding positions at which ink ejected from the ink end respectively in the first flow-in section and the second flow-in section. A first direction of ejection of ink in the first flow-in section of the first common ink ejection flow path has a component opposite to a second direction of ejection of ink in the second flow-in section of the second common ink ejection flow path.

10 Claims, 14 Drawing Sheets

(51) Int. Cl.
*B41J 2/155* (2006.01)
*B41J 2/18* (2006.01)

(52) U.S. Cl.
CPC ..... *B41J 2/18* (2013.01); *B41J 2002/14306* (2013.01); *B41J 2202/21* (2013.01)

(58) Field of Classification Search
CPC .... B41J 2/14024; B41J 2/14209; B41J 2/155; B41J 2002/14306; B41J 2/04581; B41J 2202/19
See application file for complete search history.

(56) References Cited

OTHER PUBLICATIONS

International Preliminary Report on Patentability with Written Opinion of the International Searching Authority for International Application No. PCT/JP2017/047168; dated Jun. 30, 2020.

* cited by examiner

INKJET HEAD AND INKJET RECORDING APPARATUS

CROSS REFERENCE TO RELATED APPLICATIONS

This is the U.S. national stage of application No. PCT/JP2017/047168, filed on Dec. 28, 2017. Priority under 35 U.S.C. § 119(a) and 35 U.S.C. § 365(b) is claimed, the disclosure of which is incorporated herein by reference.

TECHNICAL FIELD

The present invention relates to an inkjet head and an inkjet recording apparatus.

BACKGROUND ART

There have been inkjet recording apparatuses that form images or the like by discharging ink from nozzles disposed on the inkjet head and landing it at desired positions. In a known inkjet head of such inkjet recording apparatuses, externally provided ink is stored in pressure chambers and ink is discharged from nozzles by changing the pressure on ink in the pressure chambers.

In such an inkjet head, when air bubbles or foreign matters enter the pressure chambers, pressure is not normally applied to ink, which leads to defective ink ejection. When ink is stored in the pressure chambers without being ejected for a long time, the solvent of ink is vaporized near the openings of the nozzles and the viscosity of ink near the openings increases. That sometimes makes it hard to obtain desired ink ejection characteristics.

There has been a technique for solving such a problem, in which an individual ink ejection flow path branched from an ink flow path from pressure chambers to nozzle openings is disposed for each of the pressure chambers and part of ink supplied to the pressure chambers is ejected to the outside of the inkjet head through the individual ink ejection flow paths together with air bubbles and foreign matters. In the inkjet heads with a plurality of ink discharge sections each of which has pressure chambers, nozzles, and individual ink ejection flow paths, the total length of the ink ejection flow paths (the individual ink ejection flow paths and the common ink ejection flow path) can be reduced by connecting the individual ink ejection flow paths in the ink discharge sections to a common ink ejection flow path so as to allow ink to be ejected to the outside via the common ink ejection flow path (for example, Patent Document 1). In that case, the amount of ink ejected from the pressure chambers through the individual ink ejection flow paths to the common ink ejection flow path per predetermined unit of time is desirably equal between the ink discharge sections, so that the characteristics of ink discharge at the ink discharge sections are not varied.

CITATION LIST

Patent Literature

Patent Document 1: JP 2008-149579A

SUMMARY OF INVENTION

Technical Problem

However, the amount of ink ejected from each of the individual ink ejection flow paths to the common ink ejection flow path increases as the connection point between the individual ink ejection flow path and the common ink ejection flow path is closer to the downstream end in the direction of ink ejection in the common ink ejection flow path. Thus, the conventional technique described above has a problem of large variation in the amount of ink ejected from a plurality of pressure chambers.

An object of the present invention is to provide an inkjet head and an inkjet recording apparatus that can suppress variation in the amounts of ink ejected from a plurality of pressure chambers.

Solution to Problem

To achieve at least one of the above-mentioned objects, the invention recited in claim 1 is an inkjet head including:

a plurality of ink discharge sections each including:

pressure chambers that store ink and change pressure on the stored ink;

nozzles communicating to the respective pressure chambers, through which ink is discharged according to the change of pressure on the ink in the pressure chambers; and first individual ink ejection flow paths and second individual ink ejection flow paths which communicate to the respective pressure chambers and through which ink is ejected from the pressure chambers without being supplied to the nozzles, wherein the nozzles are disposed at different positions in a predetermined direction;

a first common ink ejection flow path which communicates to the first individual ink ejection flow paths of the plurality of ink discharge sections and into which ink flows through the first individual ink ejection flow paths in a first flow-in section; and a second common ink ejection flow path which communicates to the second individual ink ejection flow paths of the plurality of ink discharge sections and into which ink flows through the second individual ink ejection flow paths in a second flow-in section, wherein the plurality of ink ejection sections are disposed in such a positional relation that, as a position of the nozzles of the plurality of ink discharge sections is nearer to a one end in the predetermined direction of an arrangement range of the nozzles of the plurality of ink discharge sections, a corresponding position at which ink ejected from the ink ejection sections flows in the first flow-in section is nearer to the one end in the predetermined direction in the first flow-in section and a corresponding position at which ink ejected from the ink ejection sections flows in the second flow-in section is nearer to the one end in the predetermined direction in the second flow-in section, wherein a first direction of ejection of ink in the first flow-in section of the first common ink ejection flow path has a component opposite to a second direction of ejection of ink in the second flow-in section of the second common ink ejection flow path.

The invention recited in claim 2 is the inkjet head according to claim 1, wherein the first direction of ejection and the second direction of ejection are opposite to one another.

The invention recited in claim 3 is the inkjet head according to claim 2, wherein at least one of the first common ink ejection flow path or the second common ink ejection flow path includes a plurality of common ink ejection flow paths, wherein the first common ink ejection flow path and the second common ink ejection flow path are alternately disposed in an orthogonal direction orthogonal to the first direction of ejection, wherein a nozzle group including two or more of the nozzles is disposed at each gap between the first common ink ejection flow path and the second common ink ejection flow path that are next to one another, in a view from a direction perpendicular to a nozzle opening surface on which openings of the nozzles are disposed, wherein, in the ink discharge sections with the nozzles in the nozzle group, the first individual ink ejection flow paths communicate to the first common ink ejection flow path nearest to the said nozzle group in the orthogonal direction, and the second individual ink ejection flow paths communicate to the second common ink ejection flow path nearest to the said nozzle group.

The invention recited in claim 4 is the inkjet head according to claim 3, wherein a minimum value of a cross-sectional area vertical to the first direction of ejection of the first flow-in section in the first common ink ejection flow path is greater as a number of the first individual ink ejection flow paths communicating to the first common ink ejection flow path is larger, wherein a minimum value of a cross-sectional area vertical to the second direction of ejection of the second flow-in section in the second common ink ejection flow path is greater as a number of the second individual ink ejection flow paths communicating to the second common ink ejection flow path is larger.

The invention recited in claim 5 is the inkjet head according to any one of claims 1 to 4, including an ink ejection outlet through which ink is ejected to an outside, wherein the first common ink ejection flow path and the second common ink ejection flow path commonly communicate to the ink ejection outlet.

The invention recited in claim 6 is the inkjet head according to any one of claims 1 to 5, wherein at least one of: the first flow-in section of the first common ink ejection flow path; or the second flow-in section of the second common ink ejection flow path has a cross-sectional area perpendicular to a direction of ejection of ink that is different at different positions in the direction of ejection.

The invention recited in claim 7 is the inkjet head according to any one of claims 1 to 6, wherein a direction of ejection of ink is opposite to one another between the first individual ink ejection flow paths and the second individual ink ejection flow paths in each of the plurality of ink discharge sections.

The invention recited in claim 8 is an inkjet recording apparatus including the inkjet head according to any one of claims 1 to 7.

The invention recited in claim 9 is the inkjet recording apparatus according to claim 8, including a first pressure control means that individually controls pressure on ink at a predetermined point on a downstream side from the first flow-in section in a direction of ejection of ink in the first common ink ejection flow path and pressure on ink at a predetermined point on a downstream side from the second flow-in section in a direction of ejection of ink in the second common ink ejection flow path.

The invention recited in claim 10 is the inkjet recording apparatus according to claim 8 or 9, including a second pressure control means that individually controls pressure on ink at a predetermined point on an upstream side from the first flow-in section in a direction of ejection of ink in the first common ink ejection flow path and pressure on ink at a predetermined point on an upstream side from the second flow-in section in a direction of ejection of ink in the second common ink ejection flow path.

Advantageous Effects of Invention

According to the present invention, variation in the amounts of ink ejected from a plurality of pressure chambers can be suppressed.

DESCRIPTION OF EMBODIMENTS

Hereinafter, embodiments of an inkjet head and an inkjet recording apparatus according to the present invention are described with reference to the drawings.

Figure 1:
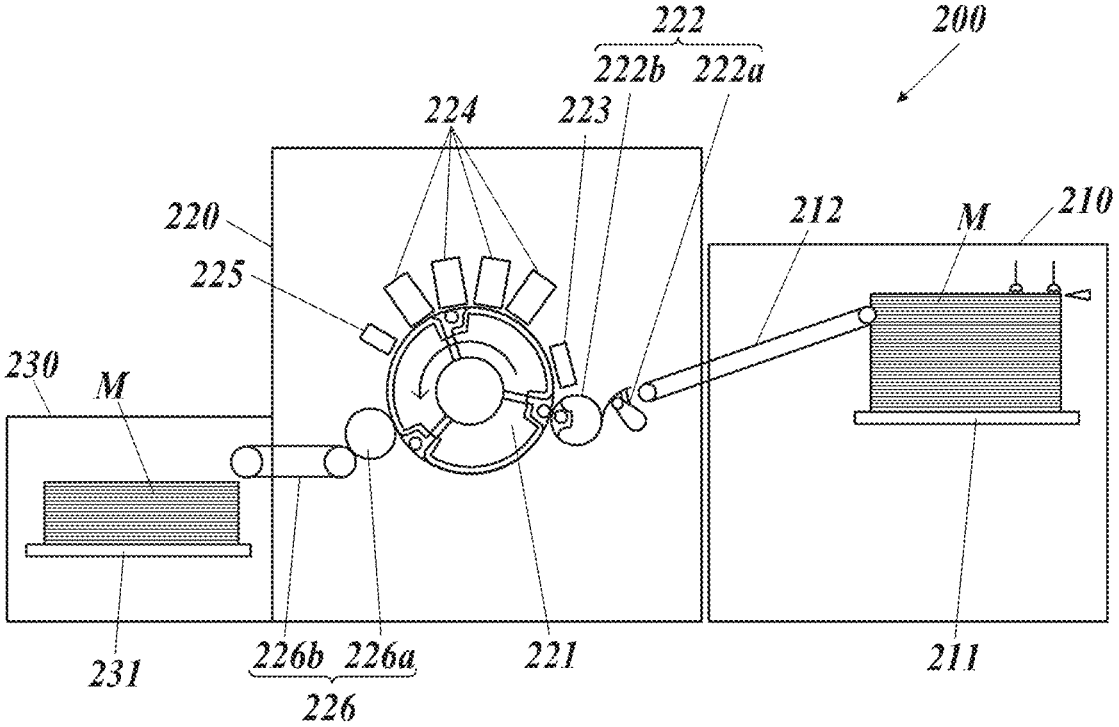
FIG. 1 shows a schematic configuration of an inkjet recording apparatus.

FIG. 1 shows a schematic configuration of an inkjet recording apparatus 200 according to an embodiment of the present invention.

The inkjet recording apparatus 200 includes a sheet feeder 210, an image recorder 220, and a sheet ejector 230. The inkjet recording apparatus 200 conveys a recording medium M stored in the sheet feeder 210 to the image recorder 220, forms an image on the recording medium M in the image recorder 220, and conveys the recording medium M with the image to the sheet ejector 230.

The sheet feeder 210 includes a sheet feeding tray 211 that stores the recording medium M and a medium feeder 212 that conveys and feeds the recording medium M from the sheet feeding tray 211 to the image recorder 220. The medium feeder 212 includes an endless belt supported on the inside by two rollers. The medium feeder 212 rotates the rollers to convey the recording medium M on the belt from the sheet feeding tray 211 to the image recorder 220.

The image recorder 220 includes, for example, a conveyance drum 221, a handover unit 222, a heater 223, a head units 224, a fixer 225, and a deliverer 226.

The conveyance drum 221 is in a column shape, the outer peripheral surface of which is a conveyance surface on which the recording medium M is placed. The conveyance drum 221 conveys the recording medium M on the conveyance surface by rotating in the direction of the arrow in FIG. 1 with the recording medium M being held on the conveyance surface. The conveyance drum 221 includes a claw and a suction unit (not show in the drawings), and holds the recording medium M on the conveyance surface by pressing the edge of the recording medium M with the claw and sucking the recording medium M to the conveyance surface with the suction unit.

The handover unit 222, which is disposed between the medium feeder 212 of the sheet feeder 210 and the conveyance drum 221, holds and receives the recording medium M conveyed from the medium carrier 212 at one end with a swing arm 222*a*, and feeds the recording medium M to the conveyance drum 221 via a delivery drum 222*b*.

The heater 223, which is disposed between the handover drum 222*b* and the head units 224, heats the recording medium M conveyed from the conveyance drum 221 so that the temperature of the recording medium M is within a predetermined temperature range. The heater 223 includes an infrared heater, for example, and heats the recording medium M as electric current is applied to the infrared heater in response to control signals from the controller (not shown in the drawings).

Each of the head units 224 discharges ink from nozzles onto the recording medium M at appropriate timings corresponding to rotation of the conveyance drum 221 holding the recording medium M so as to form an image according to image data. The head units 224 are disposed in a state where a nozzle opening surface on which nozzle openings are disposed is opposed to the conveyance surface of the conveyance drum 221, separated from the conveyance surface by a predetermined distance. The inkjet recording apparatus 200 according to this embodiment includes four head units 224 corresponding to ink in four colors, yellow (Y), magenta (M), cyan (C), and black (K), which are disposed at predetermined intervals in the order of Y, M, C, K from the upstream of conveyance of the recording medium M.

Figure 2:
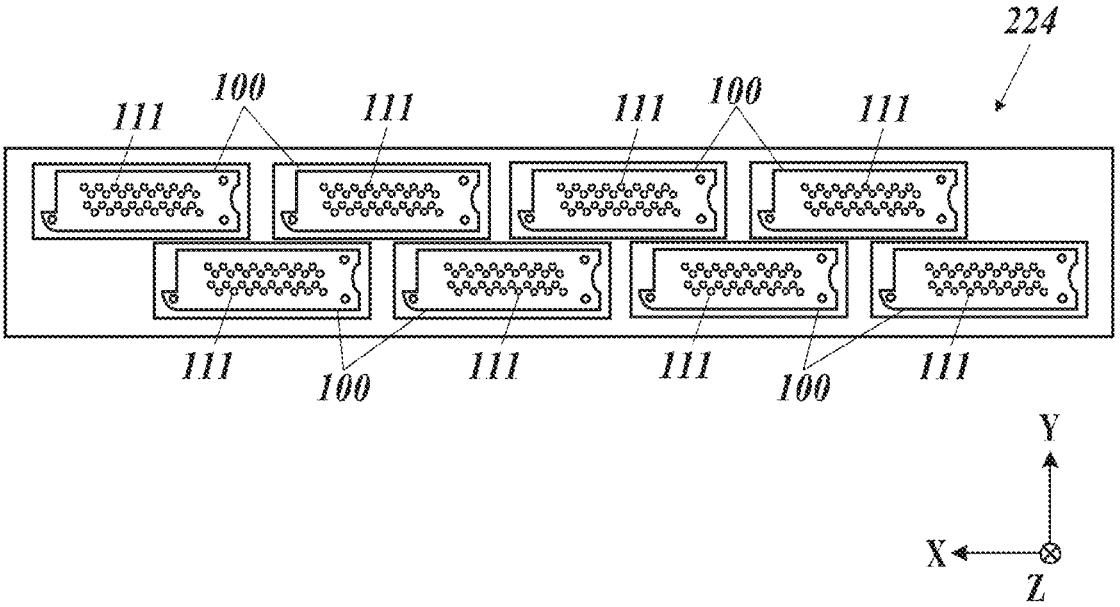
FIG. 2 shows a schematic configuration of a head unit.

FIG. 2 shows a schematic configuration of the head unit 224, and is a plan view of the head unit 224 viewed from the side opposite to the conveyance surface of the conveyance drum 221.

The head unit 224 includes eight inkjet heads 100 with nozzles 111 arranged at equal intervals in the direction intersecting the conveyance direction of the recording medium M (the width direction orthogonal to the conveyance direction, i.e. the X direction, in this embodiment).

Each of the inkjet heads 100 includes four rows (nozzle rows) of the nozzles 111 one-dimensionally arranged at equal intervals in the X direction. The positions of the four nozzle rows 111 are shifted in the X direction so as to be different from one another in the X direction.

The number of the nozzle rows included in the inkjet head 100 is not limited to four, and may be three or less or five or more.

The eight inkjet heads 100 in the head unit 224 are arranged in a staggered pattern so that the arrangement range of the nozzles 111 is continuous in the X direction. The arrangement range of the nozzles 111 included in the head unit 224 in the X direction covers the width in the X direction of the area where images can be recorded of the recording medium M conveyed by the conveyance drum 221. The head units 224 are used in a fixed state during image recording, and record an image in the single-path mode by discharging ink from the nozzles 111 at each position at a predetermined interval in the conveyance direction (conveyance-direction interval) in accordance with conveyance of the recording medium M.

The fixer 225 includes a light emitter disposed in the width of the X direction of the conveyance drum 221. The fixer 225 emits energy rays such as ultraviolet rays from the light emitter toward the recording medium M on the conveyance drum 221 for hardening the ink discharged onto the recording medium M to be fixed. The light emitter of the fixer 225 is disposed opposed to the conveyance surface, on the downstream side of the position of the head units 224 and on the upstream side of the position of the hand-over drum 226*a* of the deliverer 226 in the conveyance direction.

The deliverer 226 includes a belt loop 226*b* supported on the inside by the two rollers, a hand-over drum 226*a* in a cylindrical shape that hands over the recording medium M from the conveyance drum 221 to the belt loop 226*b*. The deliverer 226 conveys, with the belt loop 226*b*, the recording medium M received from the conveyance drum 221 onto the belt loop 226*b* with the hand-over drum 221, and sends the recording medium M to the sheet ejector 230.

The sheet ejector 230 includes a plate-shaped sheet ejection tray 231 on which the recording medium M sent out from the image recorder 220 by the deliverer 226 is placed.

Hereinafter, a configuration of the inkjet heads 100 is described.

Figure 3:
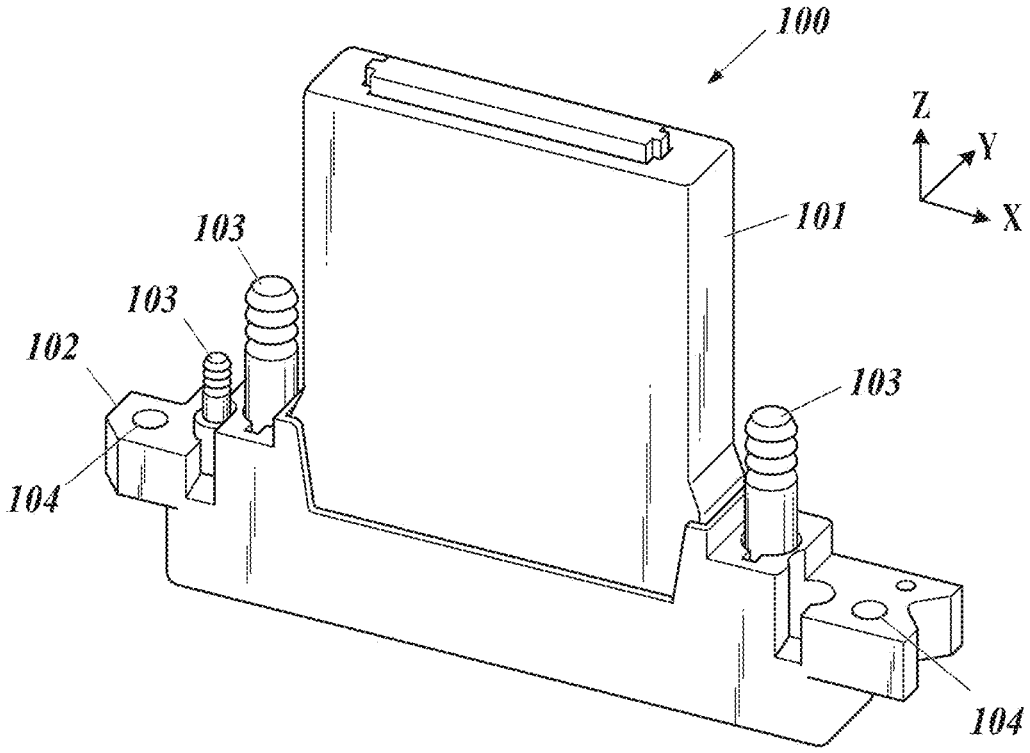
FIG. 3 shows a perspective view of an inkjet head.

FIG. 3 shows a perspective view of the inkjet head 100.

As shown in this figure, the inkjet head 100 includes a case 101, an outer member 102 fitting the case 101 at the end of the case 101, and main components of the inkjet head 100 are contained in the case 101 and the outer member 102. A joint member(s) 103, to which a port or the like of the inkjet head 100 for supply and ejection of ink are connected are attached to the outer member 102. A plurality of mounting holes 104 for mounting the inkjet head 100 to a base board of the head unit 224 not shown in the drawings is disposed on the outer member 102.

Figure 4:
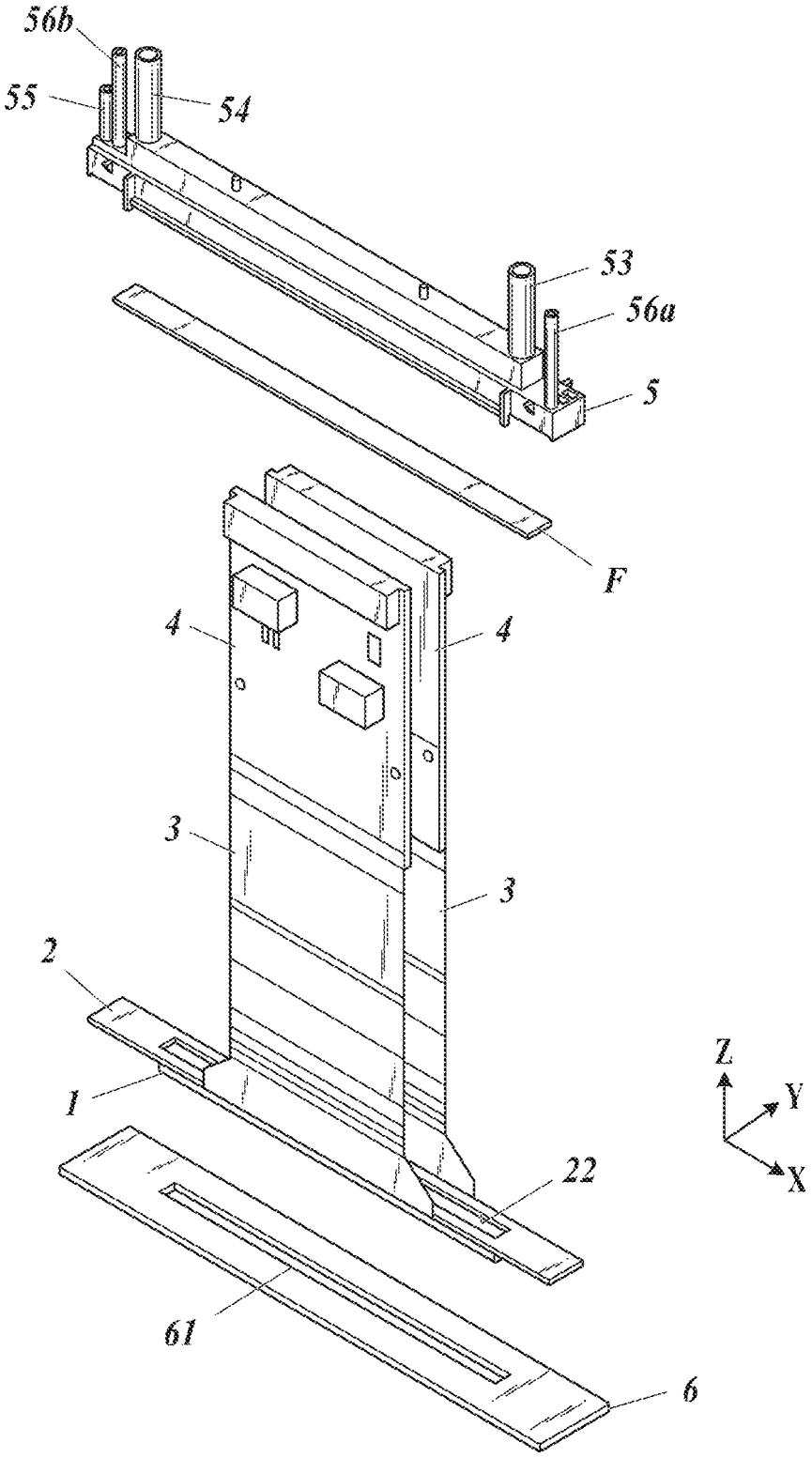
FIG. 4 shows an exploded perspective view of the inkjet head.

FIG. 4 shows an exploded perspective view of the inkjet head 100. In FIG. 4, the components contained inside the case 101 and the outer member 102 shown in FIG. 3. As shown in this figure, the inkjet head 100 includes a head chip 1 on which the nozzles 111 are disposed, a wiring base aboard 2 electrically connected to the head chip 1, a drive circuit base board(s) 4 electrically connected with the wiring base board 2 through a flexible base board(s) 3, a manifold 5 in which ink is supplied to the head chip 1, and a cap receiving board 6 attached to cover the bottom opening of the outer member 102.

The head chip 1, which is a plate-shaped member in a rectangular shape longer in the X direction, includes the nozzles 111, pressure chambers 131 (FIG. 6) which is connected to the nozzles 111 and in which ink supplied from the pressure chambers 131 to the nozzles 111 is stored, and kinds of ink ejection flow paths through which part of ink not supplied from the pressure chambers 131 to the nozzles 111 is ejected (drained). A configuration of the head chip 1 is described in detail later.

The wiring base board 2 is a plate-like rectangular member longer in the X direction with an opening 22 substantially at the center. The widths in the X and Y directions of the wiring base board 2 are respectively wider than those of the head chip 1. In a state where the head chip 1 is attached to the wiring base board 2, each inlet of the pressure chambers 131 and each outlet of the ink ejection flow paths in the head chip 1 are exposed on the upper side through the opening 22.

The flexible base board 3 is a base board on which wiring for electrically connects the drive circuit base board 4 to the electrode of the wiring base board 2 is disposed. Signals from the drive circuit base board 4 can be applied to the drive electrode disposed on the partition 136 (FIG. 11A) in the head chip 1 via the flexible base board 3.

The manifold 5 is fixed to the outer peripheral area of the wiring base board 2 at the lower end. That is, the manifold 5 is disposed on the inlet-side (the upper side) of the pressure chambers 131 of the head chip 1, and is connected to the head chip 1 via the wiring base board 2. The manifold 5, which is formed of resin, includes a hollow main body with an ink storage 51 (FIG. 5) in which ink sent to the pressure chambers 131 is stored, a first ink port 53, a second ink port 54, a third ink port 55, and fourth ink ports 56*a* and 56*b*, which serve as an outlet/inlet of the inkjet head 100. The ink storage 51 in the main body is separated into a first liquid chamber 51*a* (FIG. 5) on the upper side and a second liquid chamber 51*b* (FIG. 5) on the lower side by a filter F for removal of dust in ink.

The first ink port 53 communicates to the upper end in the +X direction of the first liquid chamber 51*a*, and ink supplied to the ink storage 51 flows therethrough.

The second ink port 54 communicates to the upper end in the −X direction of the first liquid chamber 51*a*, and is used to remove air bubbles in the first liquid chamber 51*a*.

The third ink port 55 (FIG. 4) communicates to the upper end in the −X direction of the second liquid chamber 51*b*, and is used to remove air bubbles in the second liquid chamber 51*b*.

The fourth ink ports 56*a* and 56*b* communicate to the ink ejection flow path(s) in the head chip 1, and ink flowing through the ink ejection flow path is ejected to the outside of the inkjet head 100 therethrough. The fourth ink port 56*a* is disposed at the end in the +X direction of the inkjet head 100, and the fourth ink port 56*b* is disposed at the end in the −X direction of the inkjet head 100.

The first to fourth ink ports 53 to 56 are respectively connected to the joints 103 shown in FIG. 103.

An opening for nozzle 61, which is longer in the left-right direction, is formed substantially at the center of the cap receiving board 6. The cap receiving board covers the bottom opening of the outer member 102 such that the nozzle opening surface of the head chip 1 is exposed through the opening for nozzle 61.

Figure 5:
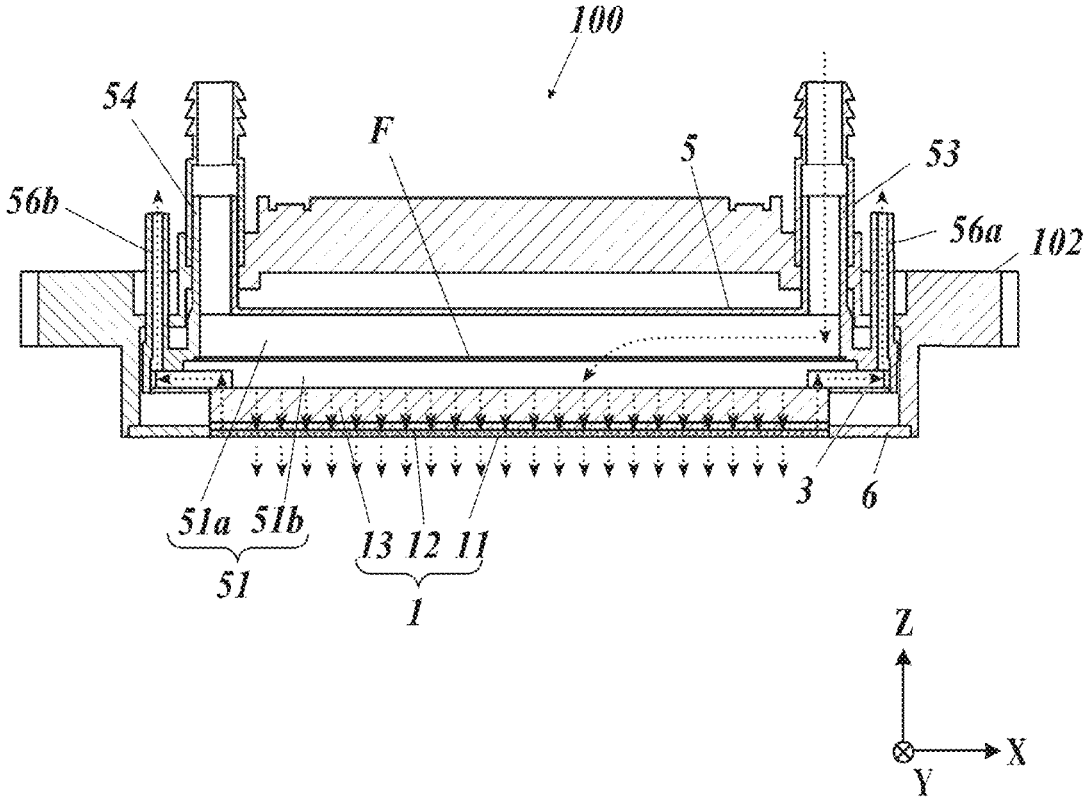
FIG. 5 shows a cross-sectional view of a main part of the inkjet head, which is taken along a plane parallel to the X-Z plane.

FIG. 5 shows a cross-sectional view of the main part of the inkjet head 100, which is taken along the plane parallel to the X-Z plane.

The head chip 1 disposed at the lowermost part of the inkjet head 100 is structured such that the nozzle base board 11 with the nozzles 111, the flow path spacer base board 12, and the pressure chamber base board 13 are layered in the written order. Further, the pressure chambers 131 communicating to the nozzles 111 and kinds of the ink ejection flow paths are disposed on the spacer base board 12 and the pressure chamber base board 13.

In the inkjet head 100, ink flowing in through the first the first ink port 53 is supplied to the first liquid chamber 51*a* and the second liquid chamber 51*b*, and the ink is supplied to the pressure chambers 131 in the head chip 1. The ink supplied to the pressure chambers 131 is discharged (jetted) from the nozzles 111 in accordance with pressure change in the pressure chambers 131. Part of ink supplied to the pressure chambers 131 is ejected to the outside through the ink ejection flow path disposed in the flow path spacer base board 12 and the pressure chamber base board 13 from the fourth ink ports 56*a* and 56*b*.

Next, the configuration of the head chip 1 is described in detail.

Figure 6:
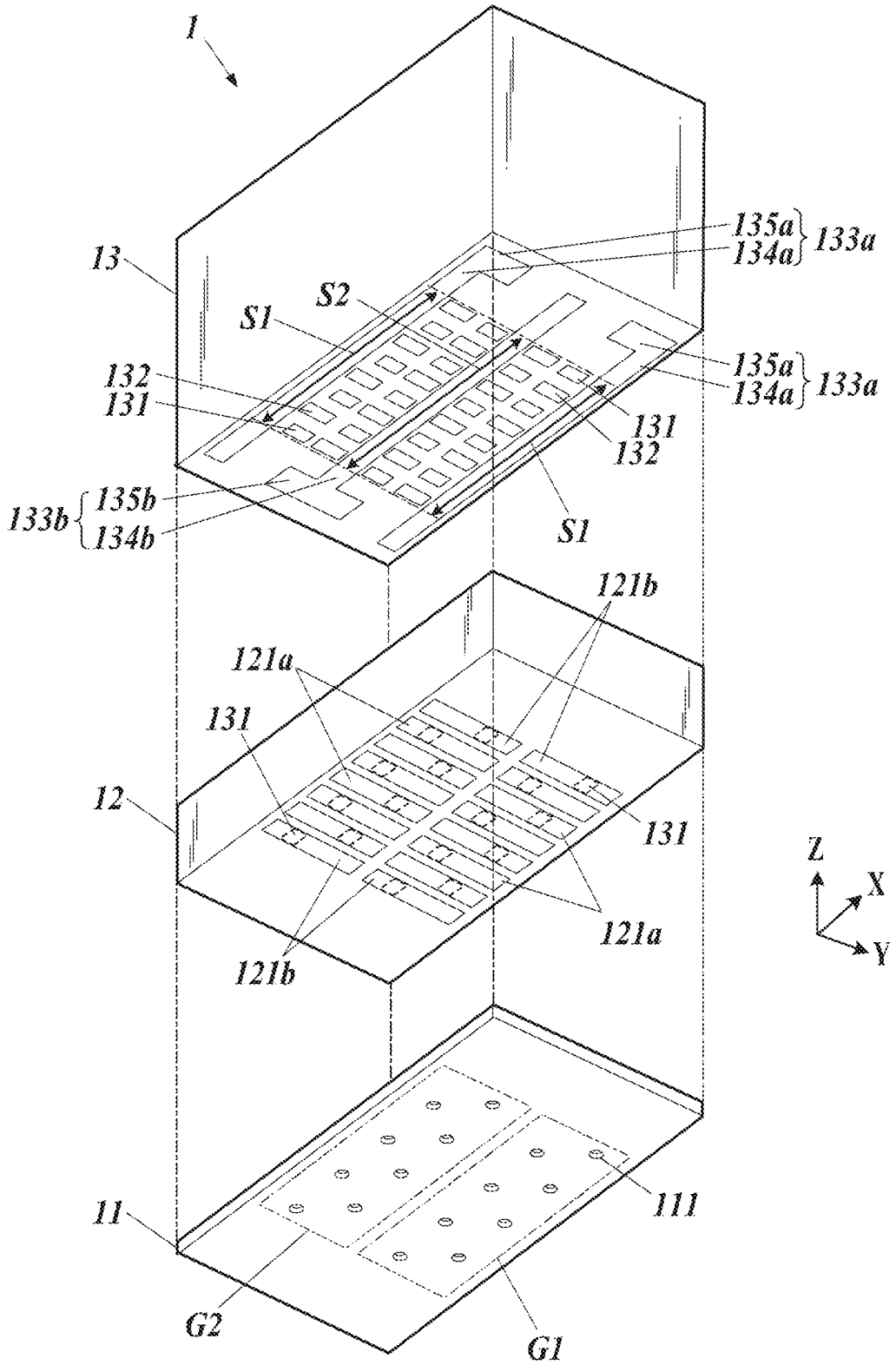
FIG. 6 shows an exploded perspective view of a head chip.

FIG. 6 shows an exploded perspective view of the head chip 1.

The pressure chamber 13 of the head chip 1 is formed of a piezoelectric material with piezoelectric characteristics such as PZT (lead zirconate titanate). The piezoelectric material of the pressure chamber base board 13 may be quartz, lithium niobate, barium titanate, lead titanate, lead metaniobate, polyvinylidene fluoride, or the like.

The flow path spacer base board 12 and the nozzle base board 11 are formed of, for example, a silicon base board. The flow path spacer base board 12 may be formed of other materials with a thermal expansion coefficient close to that of the material of the pressure chamber base board 13 and the nozzle base board 11, such as stainless steel and 42 alloy, for example. The nozzle base board 11 may be made of resin such as polyimide or metal.

Hereinbelow, the surface on the +Z direction side of each base board of the head chip 1 is referred to as the upper surface, and the surface on the −Z direction side is referred to as the lower surface.

Among the four nozzle rows disposed on the nozzle base board 11, a group of the nozzles 111 in two nozzle rows nearer to the edge in the +Y direction is referred to as the first nozzle group G1, and a group of the nozzles 111 in two nozzle rows nearer to the edge in the −Y direction is referred to as the second nozzle group G2. The nozzles 111 in the first nozzle group G1 and the nozzles 111 in the second nozzle group G2 are respectively "a plurality of nozzles."

The pressure chambers 131 penetrate the pressure chamber base board 13 and the flow path spacer base board 12 in the Z direction from the upper surface of the pressure chamber base board 13 to the lower surface of the flow path spacer base board 12. The pressure chamber 131 has a cross section taken along the X-Y planes in a rectangular shape longer in the Y direction. The pressure chamber 131 communicates to the ink storage 51 through the opening on the upper surface, and ink supplied from the ink storage 51 is stored therein. The pressure chambers 131 communicate to the nozzles 111 on the nozzle base board 11 through the openings on the lower surface of the flow path spacer baseboard 12.

Air chambers 132, which have a rectangular cross section slightly larger than the pressure chamber 131 extending in the Z direction, are disposed on the pressure chamber base board 13. Each of the air chambers 132 is a hole formed on the lower surface of the pressure chamber base board 13, and does not penetrate the pressure chamber base board 13 to the upper surface. The air chambers 132 are not disposed on the flow path spacer base board 12.

The pressure chambers 131 and the air chambers 132 are alternately disposed in the X direction to form rows. Hereinafter, the rows formed by the pressure chambers 131 and the air chambers 132 are referred to as "chamber rows" for convenience. The head chip 1 in this embodiment includes four chamber rows disposed at positions different from one another in the Y direction. The four chamber rows respectively correspond to the four nozzle rows described above. That is, the pressure chambers 131 in the chamber rows communicate to the nozzles 111 in the corresponding nozzle rows.

The pressure chambers 131 and the air chambers 132 are divided by the partitions 136 (FIG. 11A) as a pressure generating means formed of the piezoelectric material of the pressure chamber base board 13. The partitions 136 have a drive electrode not shown in the drawings, and the pressure on ink in the pressure chamber 131 is changed as shear-mode displacement is repeated on the partitions 136 according to the drive signals applied to the drive electrode. Ink in the pressure chambers 131 is ejected from the nozzles 111 according to the pressure change. As the pressure chambers 131 and the air chambers 132 are alternately disposed, the pressure chambers 131 do not contact each other. In that way, when one of the partitions 136 in contact with one of the pressure chambers 131 is deformed, the rest of the pressure chambers 131 are not affected by the deformation. Only the pressure chambers 131 may be formed without the air chambers 132.

The first common ink ejection flow paths 133*a* and the second common ink ejection flow path 133*b* which are part of the ink ejection flow path described above (hereinafter referred to as the common ink ejection flow paths 133 if not distinguished from each other) are disposed on the pressure chamber base board 13.

Out of ink supplied to the pressure chambers 131, ink not supplied to the nozzles 111 but ejected flows back from the flow path spacer base board 12 side to the common ink ejection flow paths 133. The pressure chambers 131 and the common ink ejection flow paths 133 are connected to one another via the first individual ink ejection flow path 121*a* and the second individual ink ejection flow path 121*b* (FIGS. 8B, 10A, and 10B) disposed on the flow path spacer base board 12 (hereinafter referred to as the individual ink ejection flow paths 121 if not distinguished from each other). Part of the common ink ejection flow paths 133 forms a through hole penetrating the pressure chamber base board 13, and the through holes communicates to the fourth ink ports 56*a* and 56*b* of the inkjet head 100 (ink ejection outlet).

More specifically, the first common ink ejection flow path 133*a* includes a horizontal common ejection flow path 134*a* in a groove shape extending in the X direction along the lower surface of the pressure chamber base board 13, and a perpendicular common ejection flow path 135*a* connected to the horizontal common ejection flow path 134*a* at the end in the +X direction and extending in the Z direction to penetrate the pressure chamber baseboard 13 between the upper surface and the lower surface. The first common ink ejection flow paths 133*a* are respectively disposed along the both ends with the four chamber rows described above in between.

In the first common ink ejection flow path 133*a*, ink flows (is ejected) in the +X direction in the whole including the first flow-in section S1 to which ink flowing through the first ink ejection flow path 121*a* of the horizontal common ejection flow paths 134*a* flows in. Ink flowing in the +X direction through the horizontal common ejection flow path 134*a* flows into the perpendicular common ejection flow path 135*a* in the Z direction and is led to the fourth ink port 56*a* in FIG. 5 to be ejected to the outside.

The second common ink ejection flow path 133*b* includes a horizontal common ejection flow path 134*b* in a groove shape extending in the X direction along the lower surface of the pressure chamber base board 13, and a perpendicular common ejection flow path 135*b* connected to the horizontal ejection flow path 134*b* at the end in the −X direction and extending in the Z direction to penetrate the pressure chamber base board 13 between the upper surface and the lower surface. The second common ink ejection flow path 133*b* is disposed between the second and third chamber rows of the four chamber rows described above.

In the second common ink ejection flow path 133*b*, ink flows (is ejected) in the −X direction in the whole including the second flow-in section S2 to which ink flowing through the second ink ejection flow path 121*b* of the horizontal common ejection flow paths 134*b* flows in. Thus, the first common ink ejection flow path 133*a* and the second common ink ejection flow path 133*b* let ink flow in opposite directions to eject ink. Ink flowing in the −X direction through the horizontal common ejection flow path 134*b* flows into the perpendicular common ejection flow path 135*b* in the Z direction, and is led to the fourth ink port 56*b* in FIG. 5 to be ejected to the outside.

The perpendicular common ejection flow paths 135*a* and 135*b* have a larger cross-sectional area than the pressure chamber 131, which improves efficiency of ink ejection.

The minimum value of the cross-sectional area of the horizontal common ejection flow path 134*b* is larger than the minimum value of the cross-sectional area of the horizontal common ejection flow path 134*a*. The minimum value of the cross-sectional area of the perpendicular common ejection flow path 135*b* is larger than the minimum value of the cross-sectional area of the perpendicular common ejection flow path 135*a*.

As described hereinbefore, in the head chip 1 in the present embodiment, the first common ink ejection flow path 133*a* and the second common ink ejection flow path 133*b* are disposed alternately in the orthogonal direction (Y direction) orthogonal to the direction of ink ejection of the first common ink ejection flow path 133*a* and the second common ink ejection flow path 133*b*, and the nozzle group G1 or the nozzle group G2 is disposed between the first common ink ejection flow path 133*a* and the second common ink ejection flow path 133*b* adjacent to each other in the Y direction viewed from the Z direction.

Part of the pressure chambers 131 and the first individual ink ejection flow path 121*a* and the second individual ink ejection flow path 121*b* branched from the pressure chambers 131 are disposed on the flow path spacer base board 12.

The first individual ink ejection flow path 121*a* includes a horizontal individual ejection flow path 122*a* (FIGS. 8B, 10A, and 10B) in a groove shape extending outward (toward the first common ink ejection flow path 133*a* in a view from the Z direction) along the Y direction from the opening of the pressure chamber 131 on the lower side of the flow path spacer base board 12, and a perpendicular individual ejection flow path 123*a* (FIGS. 8B, 10A, and 10B) connected to the horizontal individual ejection flow path 122*a* at the end in the Y direction and penetrating the flow path spacer base board 12 between the upper surface and the lower surface in the Z direction. The first individual ink ejection flow path 121*a* leads ink in the pressure chambers 131 to the first ink ejection flow path 133*a* through the horizontal individual ejection flow path 122*a* and the perpendicular individual ejection flow path 123*a*. The second individual ink ejection flow path 121*b* includes a horizontal individual ejection flow path 122*b* (FIGS. 8B, 10A, and 10B) in a groove shape extending inward (toward the second common ink ejection flow path 133*b* in a view from the Z direction) along the Y direction from the opening of the pressure chamber 131 on the lower side of the flow path spacer base board 12, and a perpendicular individual ejection flow path 123*b* (FIGS. 8B, 10A, and 10B) connected to the horizontal individual ejection flow path 122*b* at the end in the Y direction and penetrating the flow path spacer base board 12 between the upper surface and the lower surface in the Z direction. The second individual ejection flow path 121*b* leads ink in the pressure chambers 131 to the second ink ejection flow path 133*b* through the horizontal individual ejection flow path 122*b* and the perpendicular individual ejection flow path 123*b*.

The nozzles 111 are through holes penetrating the nozzle base board 11 in the thickness direction (Z direction). The inner wall of the nozzle 111 may be in a tapered shape that has a cross-sectional area perpendicular to the Z direction getting smaller toward the opening on the ink discharge side.

An ink discharge section is formed by the pressure chamber 131, the nozzle 111 communicating to the pressure chamber 131, and the first individual ink ejection flow path 121*a* and the second individual ink ejection flow path 121*b* communicating to the pressure chamber 131 among the components disposed in the head chip 1 described above. Thus, the head chip 1 includes the ink discharge sections equal to the nozzles 111 in number.

A protection membrane with ink resistance is preferably disposed on the flow path surface of the pressure chambers 131, the individual ink ejection flow paths 121, the common ink ejection flow paths 133, and the nozzles 111 which are flow paths of ink in the head chip 1, in view of flow path protection.

Next, the spatial arrangement and positional relations of the pressure chambers 131, the air chambers 132, the individual ink ejection flow paths 121, the common ink ejection flow paths 133, and the nozzles 111 are described with reference to FIGS. 7A to 11.

Figure 7A:
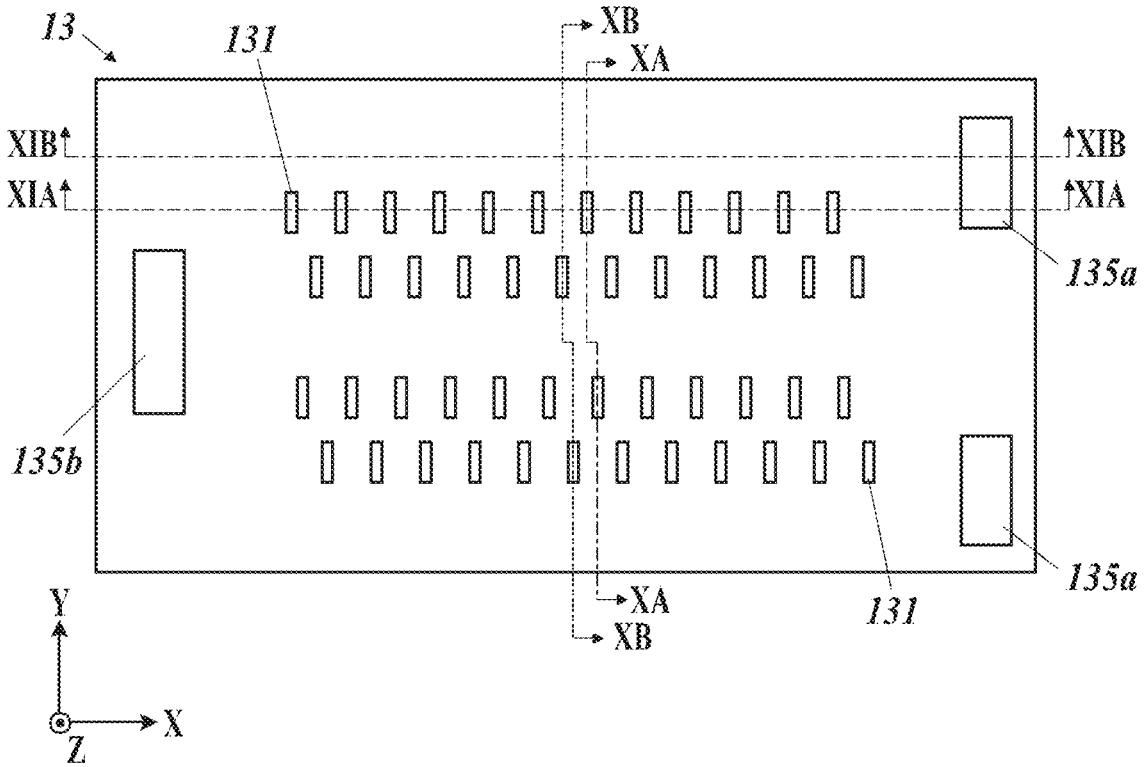
FIG. 7A shows a plan view of an upper surface of a pressure chamber base board.
Figure 7B:
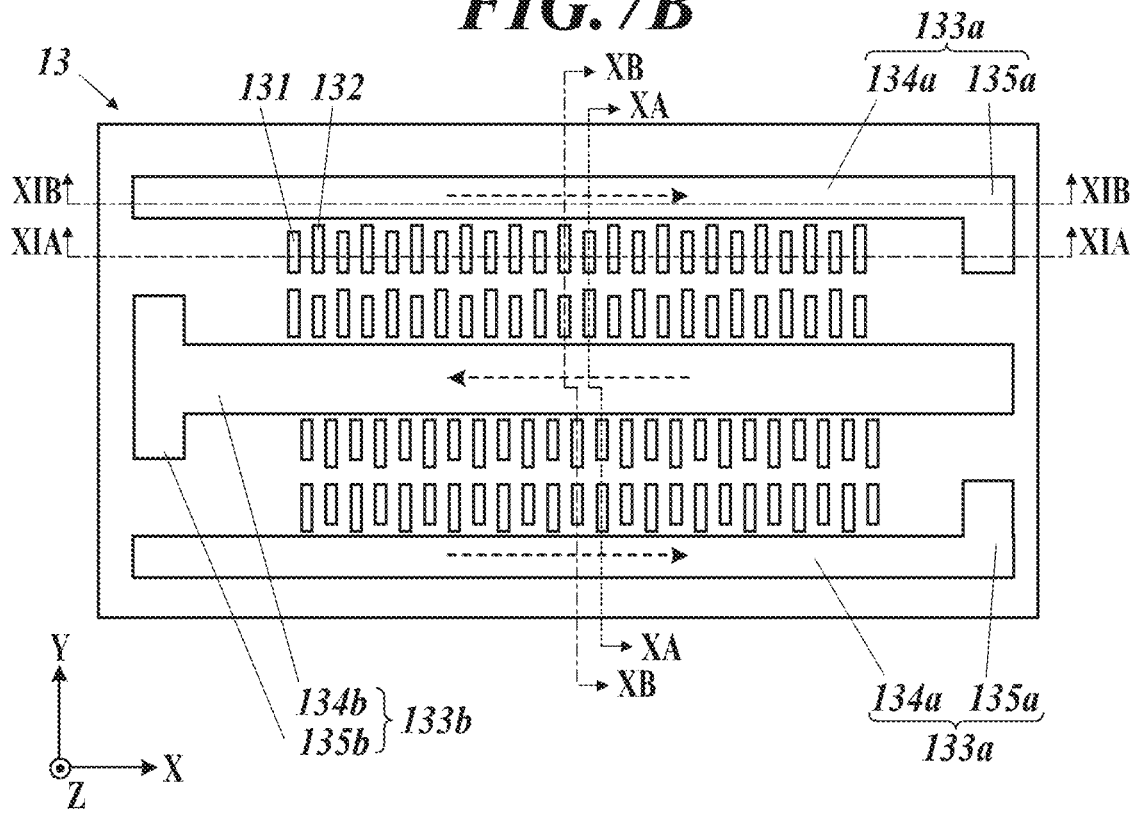
FIG. 7B shows a plan view of a lower surface of the pressure chamber base board.

FIG. 7A shows a plan view of the upper surface of the pressure chamber base board 13. FIG. 7B shows a plan view of the lower surface of the pressure chamber base board 13.

Figure 8A:
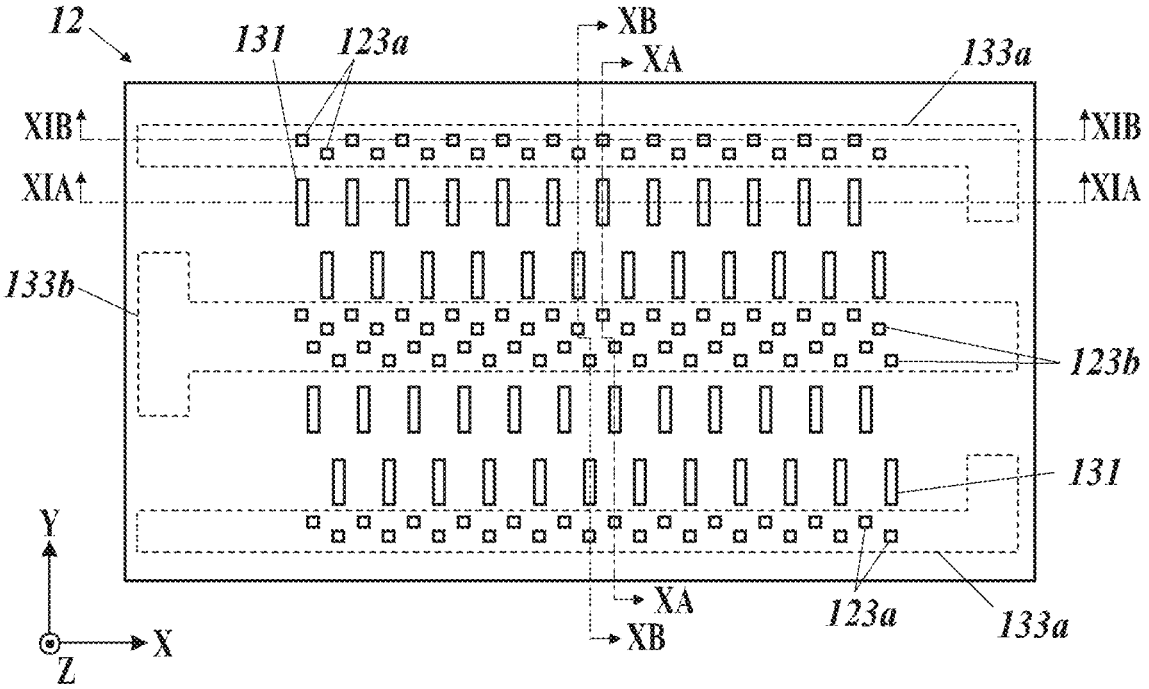
FIG. 8A shows a plan view of an upper surface of a flow path spacer base board.
Figure 8B:
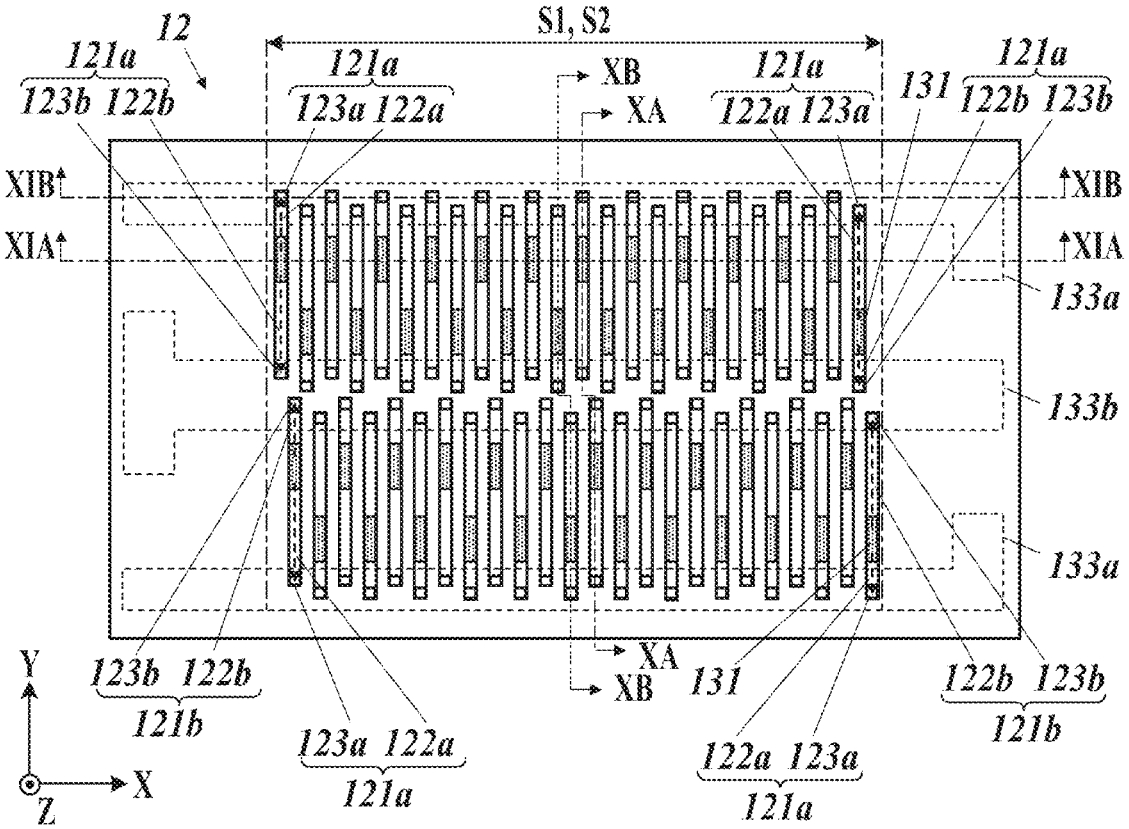
FIG. 8B shows a plan view of a lower surface of the flow path spacer base board.

FIG. 8A shows a plan view of the upper surface of the flow path spacer base board 12. FIG. 8B shows a plan view of the lower surface of the flow path base board 12.

Figure 9:
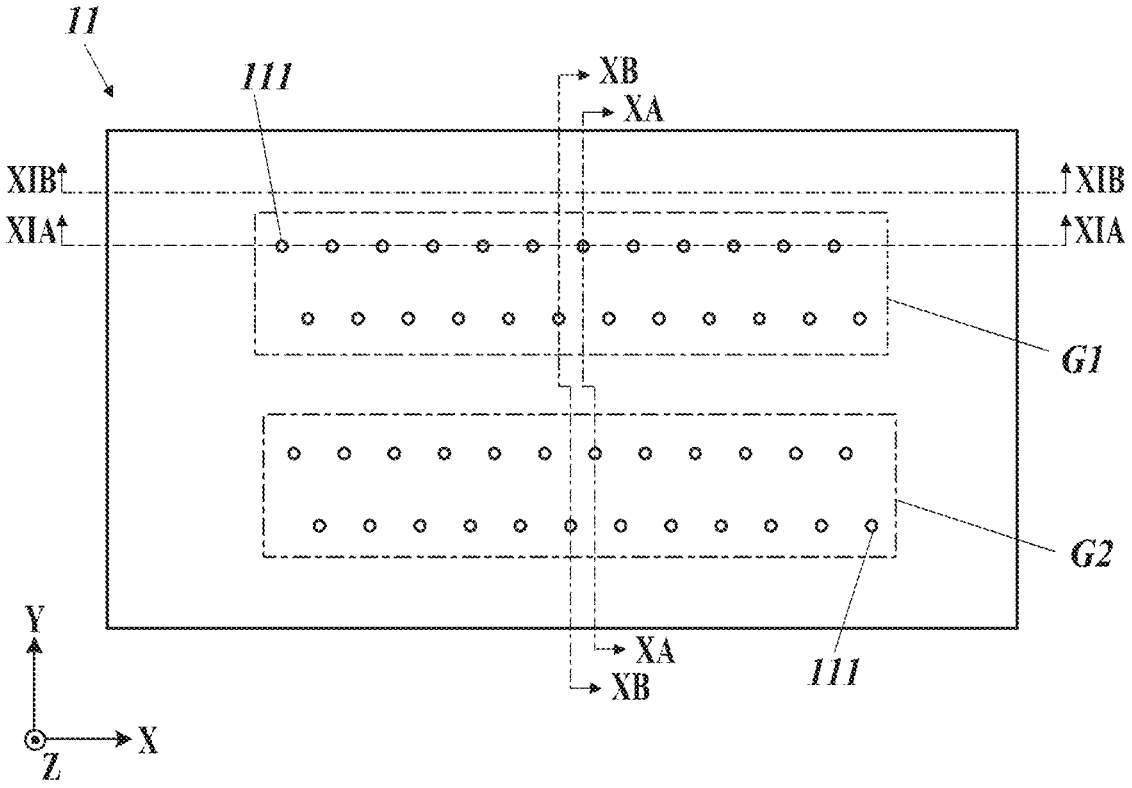
FIG. 9 shows a plan view of a nozzle base board.

FIG. 9 shows a plan view of the nozzle base board 11.

Figure 10A:
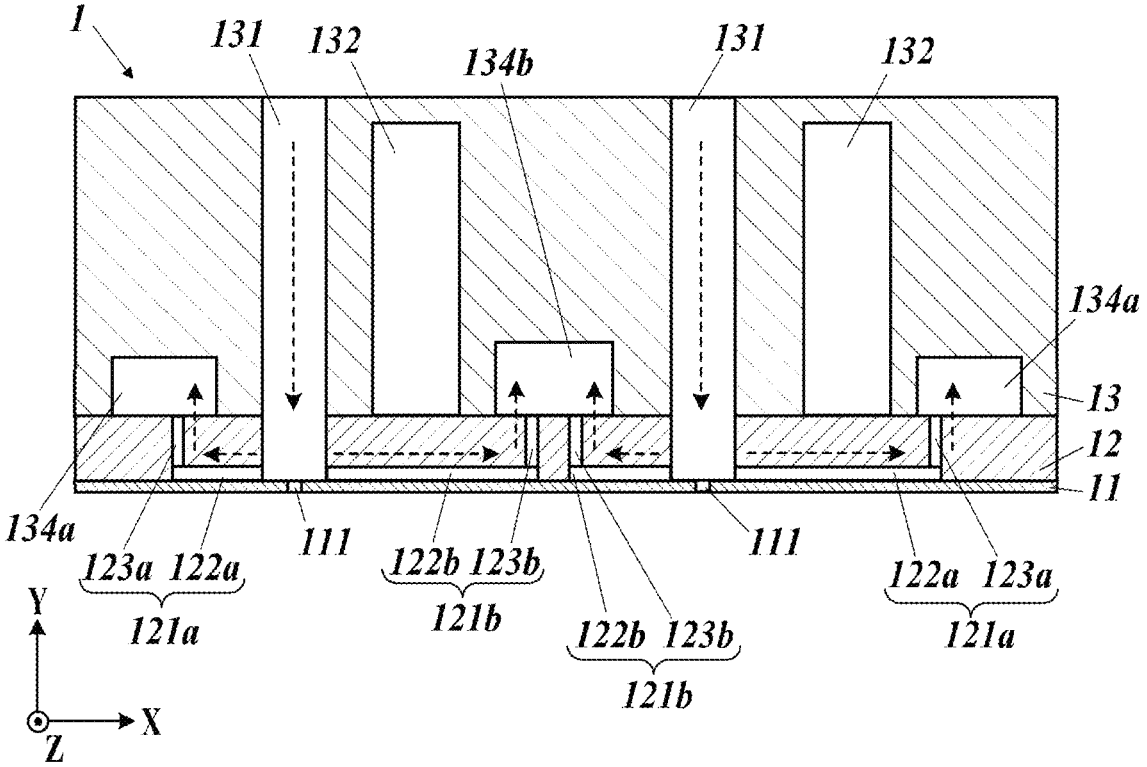
FIG. 10A shows a cross-sectional view of the head chip taken along the line XA.

FIG. 10A shows a cross-sectional view of the head chip 1 taken along the line XA.

Figure 10B:
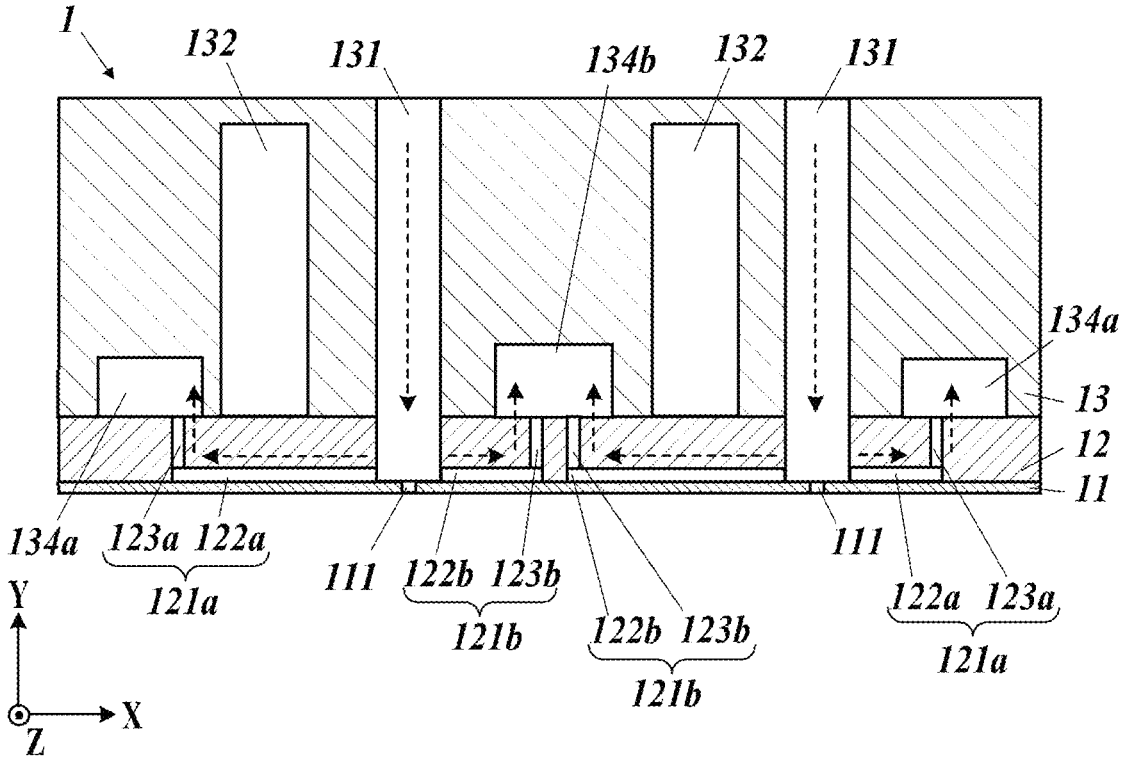
FIG. 10B shows a cross-sectional view of the head chip taken along the line XB.

FIG. 10B shows a cross-sectional view of the head chip 1 taken along the line XB.

Figure 11A:
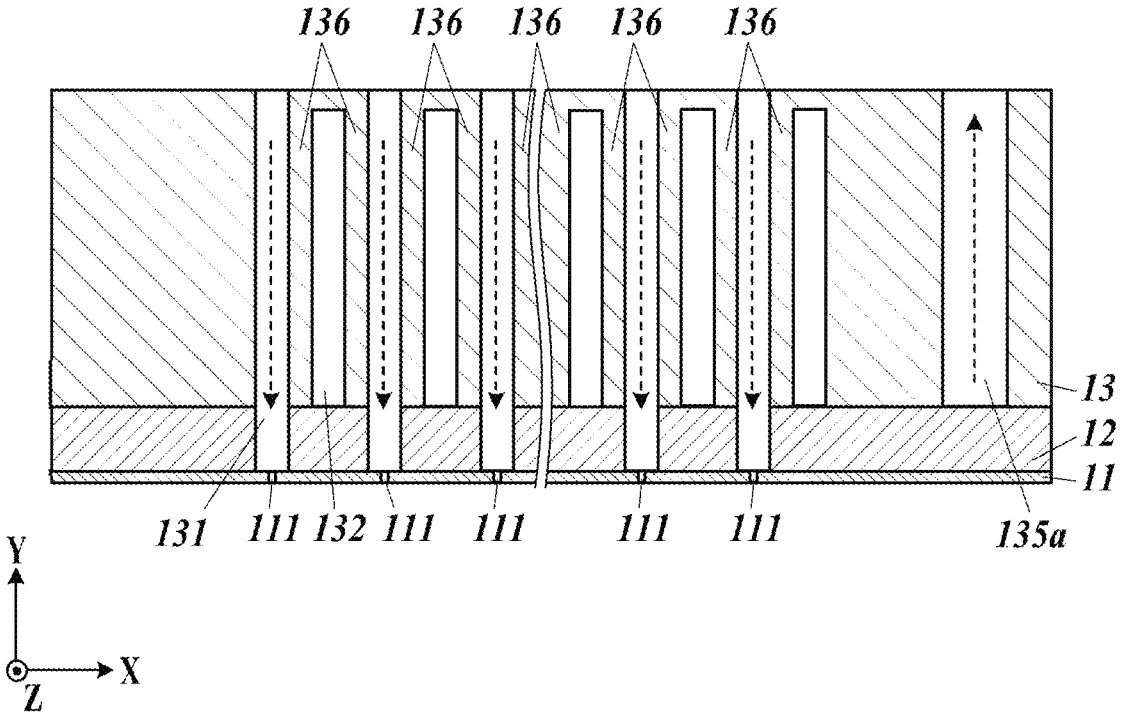
FIG. 11A shows a cross-sectional view of the head chip taken along the line XIA.

FIG. 11A shows a cross-sectional view of the head chip 1 taken along the line XIA.

Figure 11B:
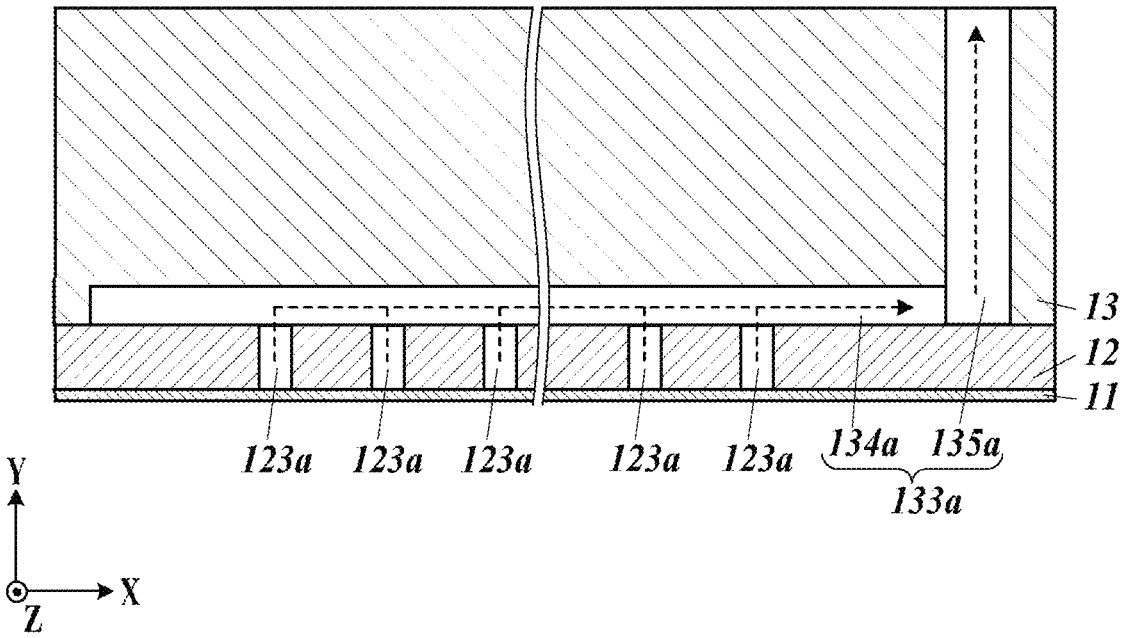
FIG. 11B shows a cross-sectional view of the head chip taken along the line XIB.

FIG. 11B shows a cross-sectional view of the head chip 1 taken along the line XIB.

Among those, FIG. 7 shows a plan view of the lower surface of the pressure chamber base board 13 which is viewed from the +X direction side and on which the components other than those on the lower surface are transparent for convenience of description. Similarly, FIG. 8B shows a plan view of the lower surface of the flow path spacer base board 12 which is viewed from the +Z direction side and on which the components other than those on the lower surface are transparent.

In FIGS. 8A and 8B, the area overlapping in the Z direction with the area in which the first common ink ejection flow paths 133*a* and the second common ink ejection flow path 133*b* are formed is indicated in a broken line.

The arrows in a broken line indicates the direction of ink ejection in FIGS. 7B, 8B, 10A, 10B, 11A, and 11B.

As shown in FIG. 7A, the openings of the pressure chambers 131, the openings of the perpendicular common ejection flow paths 135*a* of the first common ink ejection flow paths 133*a*, and the openings of the perpendicular common ejection flow path 135*b* of the second common ink ejection flow path 133*b* are formed on the upper surface of the pressure chamber base board 13. The positions of the openings of the pressure chambers 131 correspond to the positions (FIG. 9) of the openings of the nozzles 111 communicating respectively to the pressure chambers 131. The same is applied to FIGS. 7B, 8A, and 8B in this regard.

The openings of the two perpendicular common ejection flow paths 135*a* are disposed near the end in the +X direction. The opening of the perpendicular common ejection flow path 135*b* is disposed near the end in the −X direction.

As shown in FIG. 7B, the openings of the pressure chambers 131 and the air chambers 132, the first common ink ejection flow paths 133*a*, and the second common ink ejection flow path 133*b* are formed on the lower surface of the pressure chamber base board 13.

As shown in FIG. 8A, the openings of the pressure chambers 131, the openings of the perpendicular individual ejection flow paths 123*a* of the first individual ink ejection flow paths 121*a*, and the perpendicular individual ejection flow path 123*b* of the second individual ink ejection flow path 121*b* are formed on the upper surface of the flow path spacer base board 12. Among those, the openings of the perpendicular individual ejection flow paths 123*a* are disposed at positions overlapping with the first common ink ejection flow path 133*a* in a view from the Z direction and communicate to the first common ink ejection flow path 133*a*. The perpendicular individual ejection flow path 123*b* is disposed at a position overlapping with the second common ink ejection flow path 133*b* in a view from the Z direction and communicates to the second common ink ejection flow path 133*b*. The communication structure of the perpendicular individual ejection flow paths 123*a* and the first common ink ejection flow path 133*a* is shown in FIG. 11B.

As shown in FIG. 8B, the openings of the pressure chambers 131, the first individual ink ejection flow paths 121*a*, and the second individual ink ejection flow paths 121*b* are formed on the lower surface of the flow path spacer base board 12. Among those, the openings of the pressure chambers 131 communicate to the openings of the nozzles 111 in FIG. 9.

Specifically, in FIGS. 8B, 10A, and 10B, concerning the pressure chambers 131 included in the two chamber rows on the +Y direction side from the central part of the head chip 1 (the pressure chambers 131 communicating to the nozzles 111 in the first nozzle group G1 in FIG. 9), ink ejected from the pressure chambers 131 to the first individual ink ejection flow path 121*a* flows in the +Y direction, and flows through the perpendicular individual ejection flow path 123*a* into the first common ink ejection flow path 133*a* (horizontal common ejection flow path 134*a*) in the first flow-in section S1. Ink ejected from the pressure chambers 131 to the second individual ink ejection flow path 121*b* flows in the −Y direction, and flows through the perpendicular individual ejection flow path 123*b* to the second common ink ejection flow path 133*a* (horizontal common ejection flow path 134*b*) in the second flow-in section S2.

The ink discharge sections with the nozzles 111 in the first nozzle group G1 are disposed such that the position where ink ejected from each of the ink discharge sections flows in the first flow-in section S1 is nearer to the end in the +X direction in the first flow-in section S1, and that the position where ink ejected from each of the ink discharge sections flows in the second flow-in section S2 is nearer to the end in the +X direction in the second flow-in section S2, as each of the nozzles 111 of the ink discharge sections is disposed nearer to the end in the +X direction of the positional range of the nozzles 111 in the first nozzle group G1. Thus, the individual ink ejection flow paths 121 extending from the pressure chambers 111 corresponding to the first nozzle group G1 to the common ink ejection flow paths 133 are disposed so as not to cross one another in a view from the Z direction.

In FIG. 8B, on contrary, concerning the pressure chambers 131 included in the two chamber rows on the −Y direction side (lower side) from the central part (the pressure chambers 131 communicating to the nozzles 111 in the second nozzle group G2 in FIG. 9), ink ejected from the pressure chambers 131 to the first individual ink ejection flow path 121*a* flows in the −Y direction, and flows through the perpendicular individual ejection flow path 123*a* into the first common ink ejection flow path 133*a* (horizontal common ejection flow path 134*a*) in the first flow-in section S1. Ink ejected from the pressure chambers 131 to the second individual ink ejection flow path 121*b* flows in the +Y direction, and flows through the perpendicular individual ejection flow path 123*b* to the second common ink ejection flow path 133*b* (horizontal common ejection flow path 134*b*) in the second flow-in section S2.

The ink discharge sections with the nozzles 111 in the second nozzle group G2 are disposed such that the position where ink ejected from each of the ink discharge sections flows in the first flow-in section S1 is nearer to the end in the +X direction in the first flow-in section S1, and that the position where ink ejected from each of the ink discharge sections flows in the second flow-in section S2 is nearer to the end in the +X direction in the second flow-in section S2, as each of the nozzles 111 of the ink discharge sections is disposed nearer to the end in the +X direction of the positional range of the nozzles 111 in the second nozzle group G2. Thus, the individual ink ejection flow paths 121 extending from the pressure chambers 111 corresponding to the second nozzle group G2 to the common ink ejection flow paths 133 are disposed so as not to cross one another in a view from the Z direction.

As described above, in each of the ink discharge sections, ink ejected from the pressure chamber 131 flows through a pair of the individual ink ejection flow paths 121 from which ink is ejected in opposite directions into the separate common ink ejection flow paths 133 respectively.

Ink is ejected from the pressure chambers 131 communicating to the nozzles 111 in the first nozzle group G1 to the first common ink ejection flow path 133*a* on the +Y direction side, and ink is ejected from the pressure chambers 131 communicating to the nozzles 111 in the nozzle group G2 to the first ink ejection flow path 133*a* on the −Y direction side. From the pressure chambers 131 communicating to all the nozzles 111 in the first nozzle group G1 and the second nozzle group G2, ink is ejected to the single second common ink ejection flow path 133*b*.

In other words, concerning the ink discharge sections with the nozzles 111 in each nozzle group, the first individual ink ejection flow path 121*a* communicates to the first common ink ejection flow path 133*a* nearest to the nozzle group in the Y direction, and the second individual ink ejection flow path 121*b* communicates to the second common ink ejection flow path 133*b* nearest to the nozzle group.

As described above, the separate first common ink ejection flow paths 133*a* are respectively used for the nozzle groups, but the second common ink ejection flow path 133*b* is commonly used by the first nozzle group G1 and the second nozzle group G2.

Here, as shown in FIGS. 10A and 10B, as the cross-sectional area of the horizontal common ejection flow path 134*b* (specifically, the minimum value of the cross-sectional area) is larger than the cross-sectional area of the horizontal common ejection flow path 134*a* (specifically, the minimum value of the cross-sectional area), the ink flow capacity in the second flow-in section S2 in the second common ink ejection flow path 133 which is commonly used as described above is larger than the ink flow capacity in the first flow-in section S1 in the first common ink ejection flow path 133*a*. The minimum value of the cross-sectional area of the horizontal common ejection flow path 134*a* can be larger as the number of the individual ink ejection flow paths 121 communicating to the first flow-in section S1 is larger, and the minimum value of the cross-sectional area of the horizontal common ejection flow path 134*b* can be larger as the number of the individual ink ejection flow paths 121 communicating to the second flow-in section S2 is larger. Typically, the minimum value of each cross-sectional area can be proportional to the number of the individual ink ejection flow paths 121 communicating thereto.

Next, an ink circulation system of the inkjet recording apparatus 200 is described.

Figure 12:
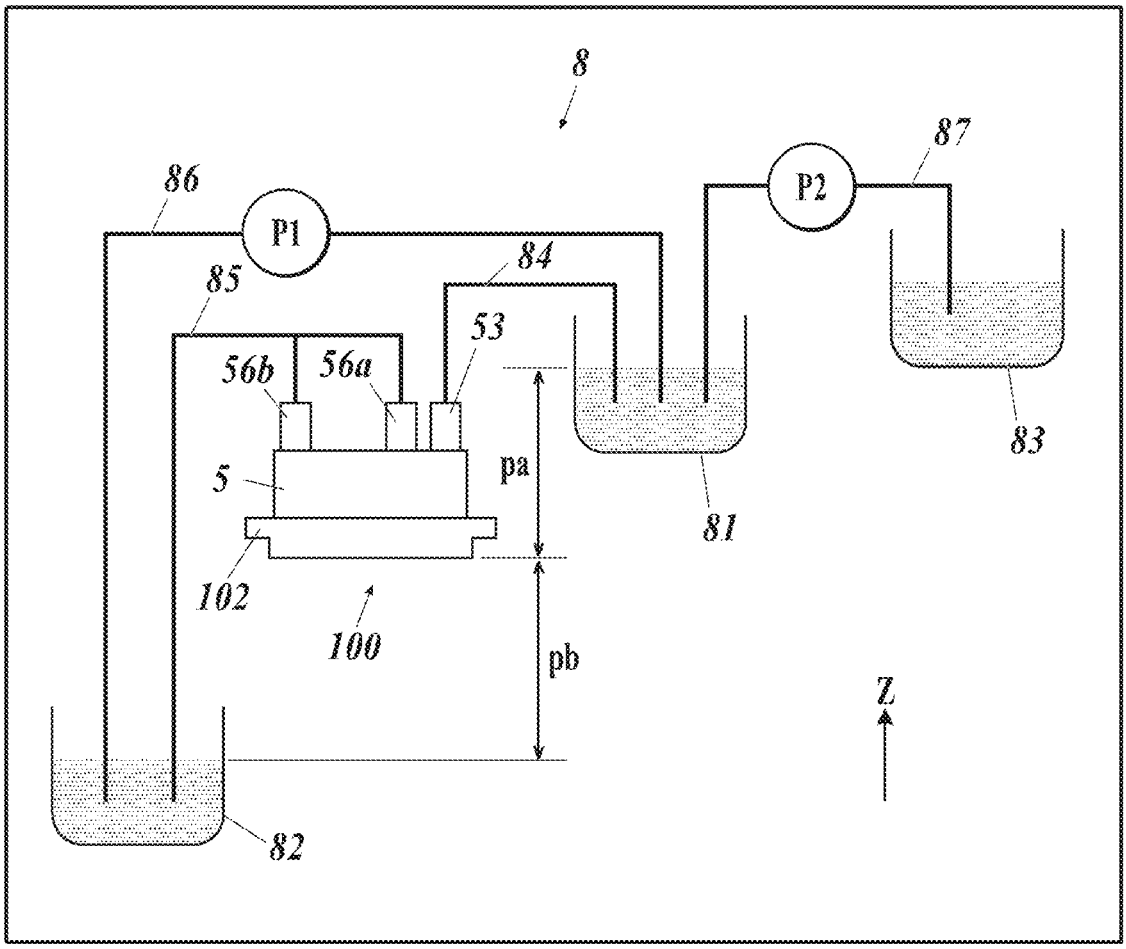
FIG. 12 schematically shows an ink circulation system of the inkjet recording apparatus.

FIG. 12 schematically shows the ink circulation system 8 of the inkjet recording apparatus 200.

The ink circulation system 8 is a mechanism for supplying ink to the pressure chambers 131 in the inkjet head 100 and ejecting ink from the pressure chambers 131 through the individual ink ejection flow paths 121 and the common ink ejection flow paths 133 to the outside of the inkjet head 100. The ink circulation system 8 includes a supply sub tank 81, a reflux sub tank 82, a main tank 83, and pumps P1 and P2.

The supply sub tank 81, a container for storing ink to be supplied to the ink storage 51 of the manifold 5, is connected to the first ink port 53 via the ink flow path 84.

The reflux sub tank 82, a container for storing ink ejected from the second ink port 54, the third ink port 55, and the fourth ink port 56*a* and 56*b* of the manifold 5, is connected to the said ink ports via the ink flow path 85. The second ink port 54 and the third ink port 55 are omitted from FIG. 12.

The supply sub tank 81 is disposed on the +Z direction side (upper side in the vertical direction) from the nozzle opening surface of the head chip 1, and the reflux sub tank 82 is disposed on the −Z direction side (lower side in the vertical direction) from the nozzle opening surface. This causes a pressure pa due to hydraulic head difference between the nozzle opening surface and the supply sub tank 81 and a pressure pb due to hydraulic head difference between the nozzle opening surface and the reflux sub tank 82. The pressure pa and the pressure pb can be adjusted as the ink filling amount in each sub tank or the position of each sub tank in the Z direction is modified.

With such a configuration, the pressure on ink at the first ink port 53 on the ink supply side (upstream side from the pressure chambers 131) is larger than the pressure on ink at the fourth ink ports 56*a* and 56*b* on the outlet side of the common ink ejection flow path (downstream side). This causes ink to flow only in the direction from the first ink port 53 through the pressure chambers 131, the individual ink ejection flow paths, 121 and the common ink ejection flow paths 133 to the fourth ink ports 56*a* and 56*b*, and prevents ink from flowing backward.

Instead of such a method using hydraulic head differences, pressure on ink at the first ink port 53 and the fourth ink ports 56*a* and 56*b* may be controlled with pumps being disposed in the ink flow path 84 or the ink flow path 85.

The supply sub tank 81 and the reflux sub tank 82 are connected via the ink flow path 86. Ink can be returned from the reflux sub tank 82 to the supply sub tank 81 by the pressure added by the pump P1 disposed in the ink flow path 86.

The main tank 83, a container for storing ink to be supplied to the supply sub tank 81, is connected to the supply sub tank 81 via the ink flow path 87. Ink can be supplied from the main tank 83 to the supply sub tank 81 by the pressure added to the pump P2 disposed in the ink flow path 87.

In the inkjet head 100 and the inkjet recording apparatus 200 with the configuration described above, as the common ink ejection flow paths 133 in which ink flows in opposite directions, variation in the flow amount of ink ejected from each of the pressure chambers 131 via the individual ink ejection flow path 121 can be suppressed. Hereinafter, this effect is described.

Figure 13:
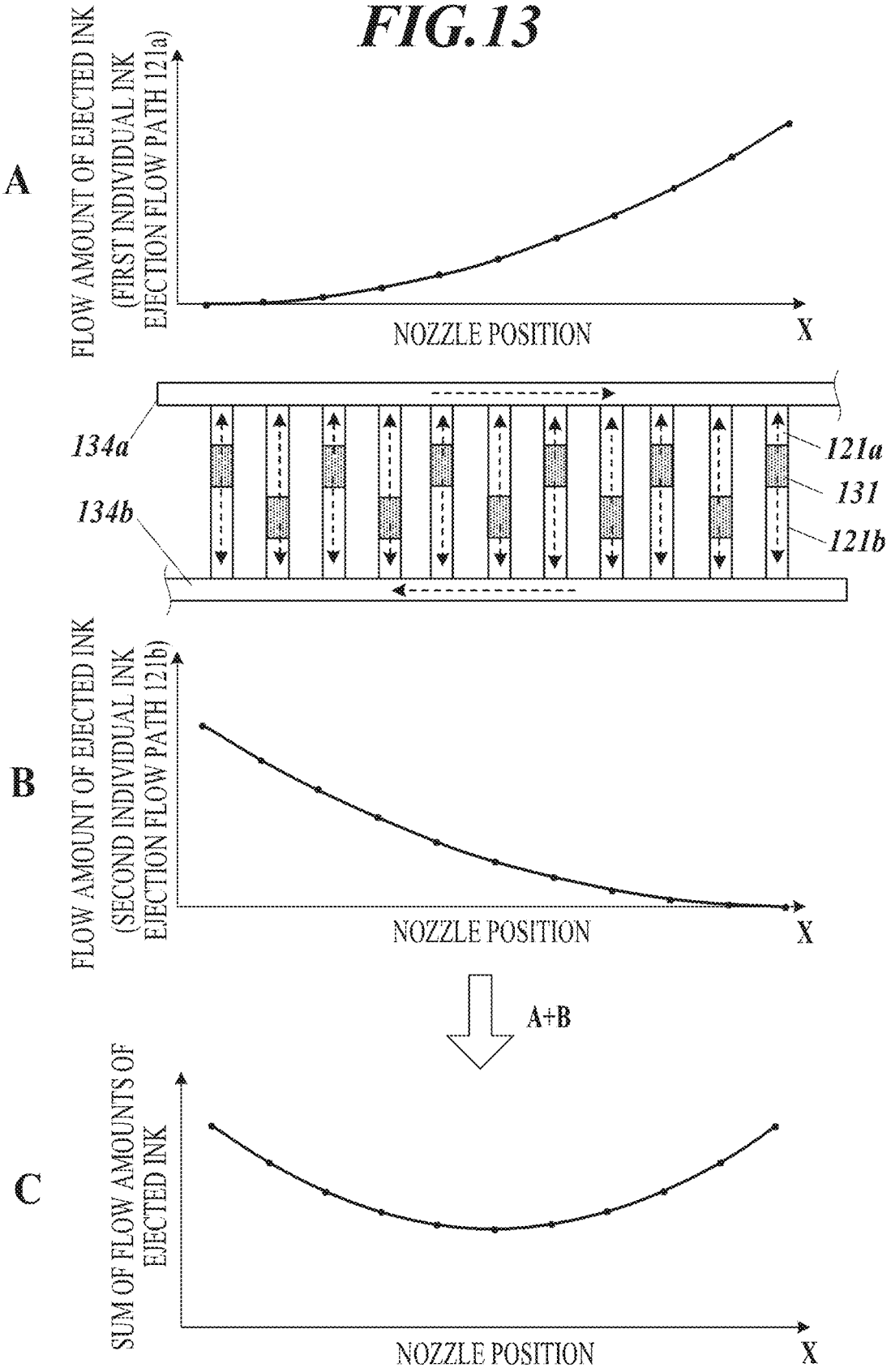
FIG. 13 shows effects of suppression of variation in the flow amounts of ink ejected from pressure chambers.

FIG. 13 shows effects of suppression of variation in the flow amount of ink ejected from the pressure chambers 131 with the configuration of this embodiment.

FIG. 13 is a schematic drawing in which the flow path of ink in the head chip 1 is shown by a simplified configuration with 11 pressure chambers 131 and a pair of the first ink ejection flow path 133*a* and the second common ink ejection flow path 133*b* communicating to the said pressure chambers 131.

The Graph A above the ink flow path diagram shows a distribution of the flow amount of ink ejected from each of the pressure chambers 131 via the first individual ink ejection flow paths 121*a* to the first common ink ejection flow path 133*a*, and the Graph B below the ink flow path diagram shows a distribution of the flow amount of ink ejected from each of the pressure chambers 131 via the second individual ink ejection flow paths 121*b* to the second common ink ejection flow path 133*b*.

The Graph C at the bottom of FIG. 13 shows a distribution of the sum of the flow amounts of ink ejected from each of the pressure chambers 131.

As shown in Graph A, the flow amount of ink ejected from each of the pressure chambers 131 to the first individual ink ejection flow path 121*a* gets smaller toward the upstream side and larger toward the downstream side in the direction of ink ejection of the first common ink ejection flow path 133*a*.

As shown in Graph B, the flow amount of ink ejected from each of the pressure chambers 131 to the second individual ink ejection flow paths 121*b* gets smaller toward the upstream side and larger toward the downstream side in the direction of ink ejection of the first common ink ejection flow path 133*b*.

This is because the difference in ink pressure from the pressure chambers 131 is smaller toward the upstream side of the common ink ejection flow path 133 due to the pressure loss in the common ink ejection flow path 133.

However, in the inkjet head 100 of this embodiment, as ink is ejected from each of the pressure chambers 131 to the first common ink ejection flow path 133*a* and the second common ink ejection flow path 133*b* flowing in opposite directions, the sum of the flow amounts of ink ejected from each of the pressure chambers 131 is the sum of the distributions of the flow amounts of Graphs A and B. Thus, compared to a case where ink is ejected from the pressure chambers 131 to a common ink ejection path 133 only (as in Graph A or Graph B), variation in the ink ejection flow amounts among the pressure chambers 131 can be suppressed.

With a configuration in which ink is ejected from the pressure chambers 131 to the first individual ink ejection flow path 121 and the second individual ink ejection flow path 121*b* opposite to one another, a problem of ink stagnation in part of the pressure chambers 131 can be effectively suppressed.

(Variation 1)

Next, Variation 1 of the above embodiment is described.

This variation is different from the above embodiment in the configuration of the downstream side of the common ink ejection flow paths 133 in the ink circulation system 8. Hereinafter, differences from the above embodiment are described.

Figure 14:
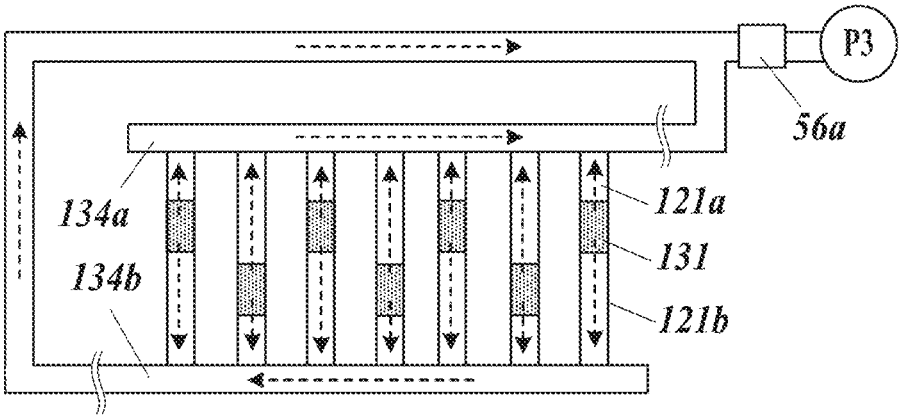
FIG. 14 schematically shows an example of the ink circulation system in Variation 1.

FIG. 14 schematically shows an example of the ink circulation system 8 in Variation 1.

In FIG. 14, the first common ink ejection flow path 133*a* and the second common ink ejection flow path 133*b* merge on the respective downstream sides, and are connected to the fourth ink port 56*a* after merge. In other words, the first common ink ejection flow path 133*a* and the second common ink ejection flow path 133*b* communicate to the fourth ink port 56*a*, a common ink ejection outlet. In FIG. 14, a pump P3 (pressure control means) for adjusting pressure on ink at the fourth ink port 56*a* is disposed. However, the pressure at the fourth ink port 56*a* may be adjusted by hydraulic head difference of ink similarly to the above embodiment.

The ink supply and ejection similar to that in the above embodiment can be realized with such a configuration. The number of the ink ports for ink ejection can be decreased with such a configuration.

Figure 15:
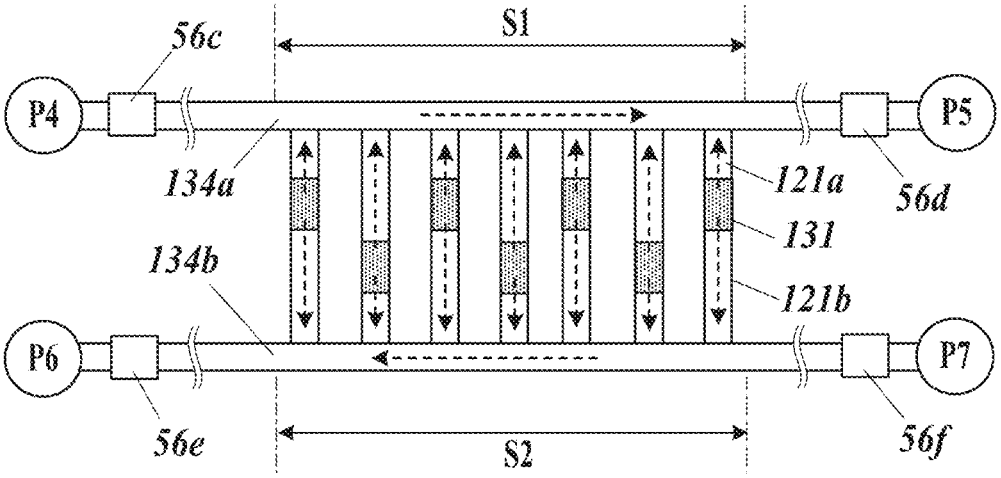
FIG. 15 shows another example of the ink circulation system in Variation 1.

FIG. 15 shows another example of the ink circulation system 8 in Variation 1.

In FIG. 15, the first flow-in section S1 in the first common ink ejection flow path 133*a* is connected to the fourth ink ports 56*c* and 56*d* respectively on the upstream and downstream sides, and the second flow-in section S2 in the second common ink ejection flow path 133*b* is connected to the fourth ink ports 56*e* and 56*f* respectively on the upstream and downstream sides. Pumps P4, P5, P6, and P7 for adjusting pressure respectively at the fourth ink ports 56*c*, 56*d*, 56*e*, and 56*f* are disposed. Among those, the first pressure control means is formed by the pumps P5 and P6 controlling the pressure on the downstream side of the common ink ejection flow path 133*a*, and the second pressure control means by the pumps P4 and P7 controlling the pressure on the upstream side.

With such a configuration, as the distribution of pressure on ink inside the first common ink ejection flow path 133*a* and the second ink ejection flow path 133*b* can be flexibly adjusted, the flow amount of ink ejected from each of the pressure chambers 131 to the first individual ink ejection flow path 121*a* and the second individual ejection flow path 121*b* can be more accurately controlled.

Instead of the configuration in FIG. 15, the first common ink ejection flow path 133*a* and the second common ink ejection flow path 133*b* may merge on the upstream sides of the first flow-in section S1 and the second flow-in section S2, or merge on the downstream sides of the first flow-in section S1 and the second flow-in section S2.

In FIG. 15, the pressure only on the downstream sides of the first common ink ejection flow path 133*a* and the second common ink ejection flow path 133*b* may be adjusted respectively by the pumps P5 and P6 as the first common ink ejection flow path 133*a* and the second common ink ejection flow path 133*b* are closed on the upstream sides so as not to be connected to the fourth ink ports 56*c* and 56*f*.

(Variation 2)

Next, Variation 2 of the above embodiment is described.

This variation is different from the above embodiment in the arrangement of the individual ink ejection flow paths 121 and the common ink ejection flow paths 133 in the head chip 1. Hereinafter, differences from the above embodiment are described.

Figure 16:
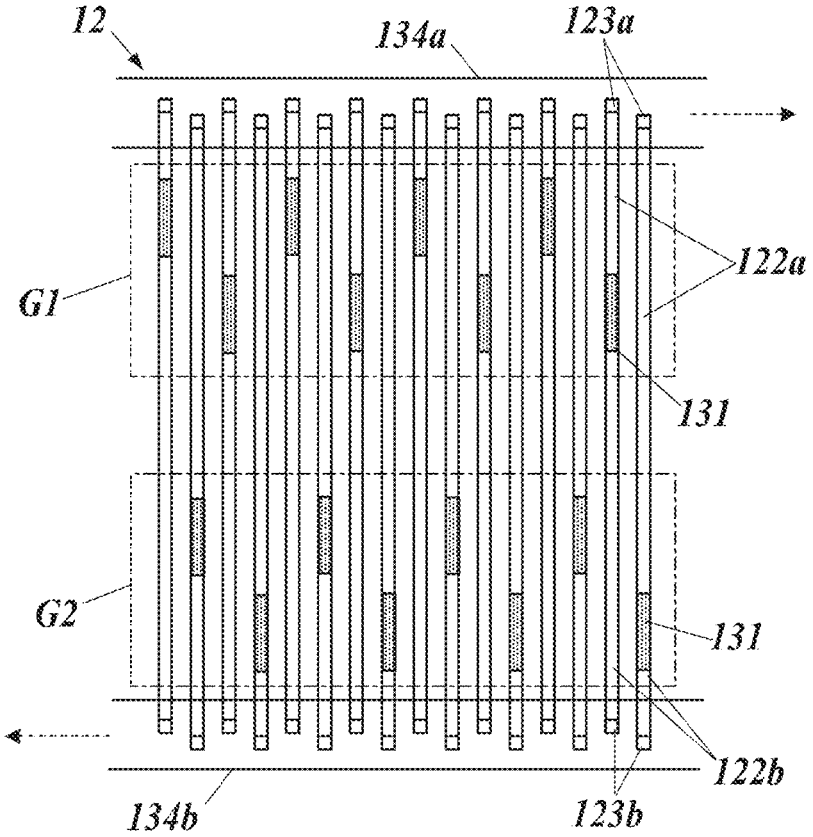
FIG. 16 shows an arrangement example of individual ejection flow paths and common ink ejection flow paths in Variation 2.

FIG. 16 shows an arrangement example of the individual ejection flow paths 121 and the common ink ejection flow path 133 in Variation 2.

In this variation, the first common ink ejection flow path 133*a* (horizontal common ejection flow path 134*a* is disposed on one side from the whole of the pressure chambers 131 corresponding to the first nozzle group G1 and the pressure chambers 131 corresponding to the second nozzle group G2 and the second common ink ejection flow path 133*b* (horizontal common ejection flow path 134*b*) on the opposite side. The individual ink ejection flow paths 121 (the horizontal individual flow paths 122 and the perpendicular individual ejection flow paths 123) from the pressure chambers 131 are directly connected to the first common ink ejection flow path 133*a* and the second common ink ejection flow path 133*b*. The ink supply and ejection similar to that in the above embodiment can be realized with such a configuration. The number of the common ink ejection flow paths 133 can be decreased with such a configuration. In the example in FIG. 16, "a plurality of nozzles" is formed by the whole of the nozzles 111 included in the first nozzle group G1 and the second nozzle group G2.

Instead of the configuration in FIG. 16, a pair of the first common ink ejection flow path 133*a* and the second common ink ejection flow path 133*b* may be disposed respectively corresponding to the first nozzle group G1 and the second nozzle group G2. There may be a pair of the first common ink ejection flow path 133*a* and the second common ink ejection flow path 133*b* may be disposed for each nozzle row.

(Variation 3)

Next, Variation 2 of the above embodiment is described.

This variation is different from the above embodiment in the shape of the common ink ejection flow paths 133. Hereinafter, differences from the above embodiment are described.

Figure 17:
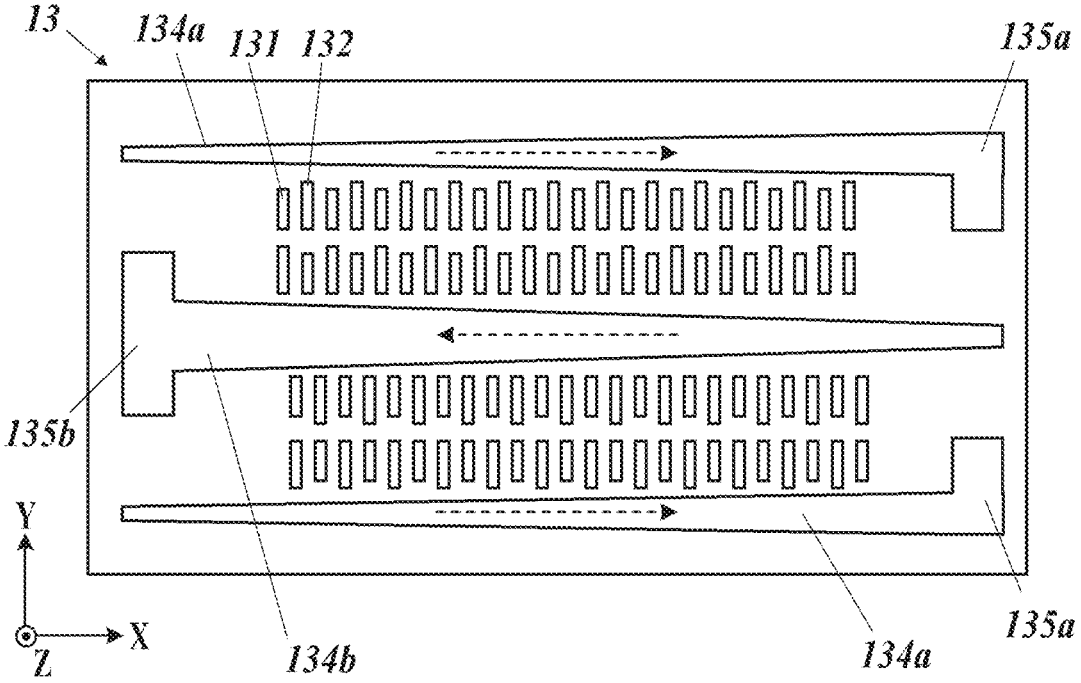
FIG. 17 shows an example of the shape of the common ink ejection flow paths in Variation 3.

FIG. 17 shows an example of the shape of the common ink ejection flow paths 133 in Variation 3.

In this variation, the cross-sectional area taken vertically to the direction of ink ejection is different depending on the position in the ejection direction in the first flow-in section S1 in the horizontal common ejection flow path 134*a* of the first common ink ejection flow path 133*a* and in the second flow-in section S2 in the horizontal common ejection flow path 134*b* of the second common ink ejection flow path 133*b*. Specifically, the cross-sectional areas of the horizontal common ejection flow path 134*a* and the horizontal common ejection flow path 134*b* get smaller toward the upstream and larger toward the downstream in the direction of ink ejection.

This makes it possible to effectively suppress variation in the ink ejection flow amount among the pressure chambers 131.

The distribution of the cross-sectional areas of the horizontal common ejection flow path 134*a* and the horizontal common ejection flow path 134*b* shown in FIG. 17 is merely an example, and the cross-sectional area does not necessarily monotonously increase or decrease to be most effective. The distribution of the cross-sectional areas of the horizontal common ejection flow path 134*a* and the horizontal common ejection flow path 134*b* can be suitably adjusted so as to lessen the variation in the ink ejection flow amount among the pressure chambers 131.

As described hereinbefore, the inkjet head 100 according to the present embodiment includes: the ink discharge sections each including: the pressure chambers 131 that store ink and change pressure on the stored ink; the nozzles 111 communicating to the respective pressure chambers 131, through which ink is discharged according to the change of pressure on the ink in the pressure chambers 131; and the first individual ink ejection flow paths 121*a* and the second individual ink ejection flow paths 121*b* which communicate to the respective pressure chambers 131 and through which ink is ejected from the pressure chambers 131 without being supplied to the nozzles 111, wherein the nozzles 111 are disposed at different positions in X direction; the first common ink ejection flow path 133*a* which communicates to the first individual ink ejection flow paths 121*a* of the ink discharge sections and into which ink flows through the first individual ink ejection flow paths 121*a* in the first flow-in section S1; and the second common ink ejection flow path 133*b* which communicates to the second individual ink ejection flow paths 121*b* of the ink discharge sections and into which ink flows through the second individual ink ejection flow paths 121*b* in the second flow-in section S2, wherein the ink ejection sections are disposed in such a positional relation that, as the position of the nozzles 111 of the plurality of ink discharge sections is nearer to a one end in X direction of the arrangement range of the nozzles 111 of the ink discharge sections, a corresponding position at which ink ejected from the ink ejection sections flows in the first flow-in section S1 is nearer to the one end in X direction in the first flow-in section S1 and a corresponding position at which ink ejected from the ink ejection sections flows in the second flow-in section S2 is nearer to the one end in the predetermined direction in the second flow-in section S2, wherein the first direction of ejection of ink in the first flow-in section S1 of the first common ink ejection flow path 133*a* has a component opposite to the second direction of ejection of ink in the second flow-in section S2 of the second common ink ejection flow path 133*b*.

In such a configuration, the flow amounts of ink ejected from the pressure chambers 131 to the first common ink ejection flow path 133*a* and the second ink ejection flow path 133*b* get larger as the connection point to the pressure chamber 131 is closer to the downstream end in the direction of ink ejection in the common ink ejection flow paths 133, but such variation in the ink ejection amount depending on the connection point can be reduced as ink is ejected to both the first common ink ejection flow paths 133*a* and the second common ink ejection flow path 133*b* in which ink flows in directions with opposite components from the pressure chambers 131. That is, as for the connection points to the pressure chambers 131 in the first flow-in section S1 of the first common ink ejection flow path 133*a* and the connection points to the pressure chambers 131 in the second flow-in section S2 of the second common ink ejection flow path 133*b*, as the connection points in one section are closer to the upstream end in the flow-in section (for example, the first flow-in section S1), the latter points in the other section are closer to the downstream end in the flow-in section (for example, the second flow-in section S2), variation in the ink ejection amount due to positioning of the connection points to the common ink ejection glow paths 133 is suppressed as for the sum of the ejection amounts to the common ink ejection flow paths 133. This makes it possible to suppress variation in the flow amount of ink ejection among the pressure chambers 131, as compared to the case where ink is ejected from the pressure chambers 131 to a common ink ejection flow path 133 in one direction. As a result of this, occurrence of the problem of air bubbles and foreign matters being hard to be ejected from part of the pressure chambers 131 is suppressed. Thus, the characteristics of ink discharge from the nozzles 111 in the inkjet head 100 can be prevented from being varied.

The first direction of ejection and the second direction of ejection are opposite to one another. This makes it possible to suppress variation in the flow amount of ink ejection from the pressure chambers 131 more accurately, as variation in the ink ejection amount due to positioning of the connection points to the pressure chambers 131 in each of the common ink ejection flow paths 133 can be effectively offset. As the first flow-in section S1 of the first common ink ejection flow path 133*a* and the second flow-in section S2 of the second common ink ejection flow path 133*b* can be disposed parallel to one another, the components of the inkjet head 100 such as the nozzle rows, the rows of pressure chambers 131 and the air chambers 132 can be arranged compactly.

In the inkjet head 100 according to the embodiment described above, the number of at least one of the first common ink ejection flow path 133*a* or the second common ink ejection flow path 133*b* is more than one, the first common ink ejection flow path 133*a* and the second common ink ejection flow path 133*b* are alternately disposed in the orthogonal direction (Y direction) orthogonal to the first direction of ejection (X direction), the nozzle group G1 or G2 including two or more of the nozzles 111 is disposed at each gap between the first common ink ejection flow path 133*a* and the second common ink ejection flow path 133*b* that are next to one another, in a view from Z direction perpendicular to the nozzle opening surface on which openings of the nozzles 111 are disposed, and wherein, in the ink discharge sections with the nozzles 111 in the nozzle group G1 or G2, the first individual ink ejection flow paths 121*a* communicate to the first common ink ejection flow path 133*a* nearest to the said nozzle group G1 or G2 in Y direction, and the second individual ink ejection flow paths 121*b* communicate to the second common ink ejection flow path 133*b* nearest to the said nozzle group G1 or G2. With such a configuration, at least one of the first common ink ejection flow path 133*a* and the second common ink ejection flow path 133*b* can be shared by a plurality of the nozzle groups, and the number of the common ink ejection flow paths 133 can be reduced. This makes it possible to achieve the downsizing and cost reduction of the inkjet head 100.

The minimum value of the cross-sectional area vertical to the first direction of ejection (X direction) of the first flow-in section S1 in the first common ink ejection flow path 133*a* is greater as the number of the first individual ink ejection flow paths communicating to the first common ink ejection flow path 133*a* is larger, and the minimum value of the cross-sectional area vertical to the second direction of ejection (X direction) of the second flow-in section S2 in the second common ink ejection flow path 133*b* is greater as the number of the second individual ink ejection flow paths communicating to the second common ink ejection flow path 133*b* is larger. This makes it possible to suppress variation in the amount of ink flowing from the pressure chambers 131 into each of the common ink ejection flow paths 133 in the case where the number of the pressure chambers 131 connected to each of the common ink ejection flow paths 133 is different from one another. For example, in the case where part of the common ink ejection flow paths 133 are shared by a plurality of the nozzle groups.

The inkjet head 100 according to Variation 1 includes the fourth ink port 56*a* through which ink is ejected to the outside, wherein the first common ink ejection flow path 133*a* and the second common ink ejection flow path 133*b* commonly communicate to the fourth ink port 56*a*. This makes it possible to reduce the number of the ink ports (the fourth ink ports 56) for ink ejection. This also makes it possible to balance the amount of ink ejected from the pressure chambers 131 to the first common ink ejection flow paths 133*a* and the second ink ejection flow paths 133*b*.

In the inkjet head 100 according to Variation 3, at least one of the first flow-in section S1 of the first common ink ejection flow path 133*a*; or the second flow-in section S2 of the second common ink ejection flow path 133*b* has a cross-sectional area perpendicular to a direction of ejection of ink that is different at different positions in the direction of ejection. This makes it possible to effectively suppress variation in the ink ejection flow amount among the pressure chambers 131.

In the inkjet head 100 according to Variation 3, the direction of ejection of ink is opposite to one another between the first individual ink ejection flow paths 121*a* and the second individual ink ejection flow paths 121*b* in each of the ink discharge sections. This makes it possible to efficiently eject ink from the pressure chambers 131 to the first individual ink ejection flow paths 121*a* and the second individual ink ejection flow paths 121*b*. Thus, the problem of ink stagnation in part of the pressure chambers 131 can be effectively suppressed.

As the inkjet recording apparatus 200 in the above embodiment includes the inkjet head 100 described above, the variation in the flow amount of ink ejection between the pressure chambers 131 in the inkjet head 100 can be suppressed.

The inkjet recording apparatus 200 according to Variation 1 includes the pumps P5 and P6 that individually control pressure on ink at a predetermined point on the downstream side from the first flow-in section S2 in the direction of ejection of ink in the first common ink ejection flow path 133*a* and pressure on ink at a predetermined point on the downstream side from the second flow-in section S2 in the direction of ejection of ink in the second common ink ejection flow path 133*b*. With such a configuration, the distribution in ink pressure inside the first common ink ejection flow paths 133*a* and the second common ink ejection flow paths 133*b* can be flexibly adjusted. Thus, the flow amount of ink ejected from the pressure chambers 131 to the first individual ink ejection flow paths 121*a* and the second individual ink ejection flow paths 121*b* can be controlled more accurately.

The inkjet recording apparatus 200 according to Variation 1 includes the pumps P4 and P7 that individually control pressure on ink at a predetermined point on the upstream side from the first flow-in section S1 in the direction of ejection of ink in the first common ink ejection flow path 133*a* and pressure on ink at a predetermined point on the upstream side from the second flow-in section S2 in the direction of ejection of ink in the second common ink ejection flow path 133*b*. With such a configuration, the distribution of ink pressure inside the common ink ejection flow path 133 can be flexibly adjusted. Thus, the flow amount of ink ejected from the pressure chambers 131 can be controlled more accurately.

The present invention is not limited to the above embodiment and variations, and various changes can be made.

For example, in the above embodiment and variations, the head chip 1 is structured such that the nozzle base board 11, the flow path spacer base board 12, and the pressure chamber base board 13 are layered in the written order. However, the structure is not limited thereto, and may be two-layered with the nozzle base board 11 and the pressure chamber base board 13, for example. In that case, the common ink ejection flow paths 121 may be disposed on the nozzle base board 11 or the pressure chamber base board 13.

In the above embodiment and variations, the first common ink ejection flow paths 133*a* and the second common ink ejection flow path 133*b* are parallel to one another on the same plane, for example. However, the arrangement is not limited thereto, and may be such that the direction of ink ejection in the first flow-in section S1 of the common ink ejection flow path 133*a* has components in the direction opposite to the direction of ink ejection in the second flow-in section S2 of the second common ink ejection flow path 133*b*. For example, the first common ink ejection flow paths 133*a* and the second common ink ejection flow path 133*b* may be disposed unparallel to one another, or disposed such that the distance from the nozzle opening surface is different from one another (such that the position in the Z direction is different).

In the above embodiment and variations, the first individual ink ejection flow paths 121*a* and the second individual ink ejection flow paths 121*b* branched from the pressure chambers 131 are connected directly to the common ink ejection flow paths 133 without merging with any other flow paths, though not limited thereto. For example, the two or more first individual ink ejection flow paths 121*a* (or the second individual ink ejection flow paths 121*b*) branched from the two or more pressure chambers 131 may merge together before connected to the common ink ejection flow path 133.

In the above embodiment and variations, the directions of ink ejection in the first individual ink ejection flow paths 121*a* and the second individual ink ejection flow paths 121*b* branched from the pressure chambers 131 are opposite to one another, though not limited thereto. For example, the structure may be such that the first individual ink ejection flow paths 121*a* and the second individual ink ejection flow paths 121*b* are branched from the pressure chambers 131 in the same direction.

The individual ink ejection flow path 121 is not necessarily branched directly from the pressure chamber 131 as long as it is branched from the ink flow path at any position between the pressure chamber 131 and the nozzle 111. Thus, in the inkjet head with the ink flow path disposed between the pressure chamber 131 and the nozzle 111, the individual ink ejection flow path 121 may be branched from the ink flow path.

In the above embodiment and variations, the inkjet head 100 of shear-mode is described, though not limited thereto, as long as there is a means of applying pressure to ink in the pressure chamber 131.

In the above embodiment and variations, the inkjet recording apparatus 200 recording images with single-pass system is described, though not limited thereto. For example, the present invention may be applied to an inkjet recording apparatus 200 that records images with the inkjet head 100 scanning.

While the present invention is described with some embodiments, the scope of the present invention is not limited to the above-described embodiment but encompasses the scope of the invention recited in the claims and the equivalent thereof.

INDUSTRIAL APPLICABILITY

The present invention can be applied to inkjet heads and inkjet recording apparatuses.

REFERENCE SIGNS LIST

1 Head Chip
2 Wiring Base Board
3 Flexible Base Board
4 Drive Circuit Base Board
5 Manifold
6 Cap Receiving Board
8 Ink Circulation System
11 Nozzle Baseboard
12 Flow Path Spacer Base Board
13 Pressure Chamber Base Board
51 Ink Storage
53-56 Ink Port
81 Supply Sub Tank
82 Reflux Sub Tank
83 Main Tank
100 Inkjet Head
101 Case
102 Outer Member
103 Joint
104 Mounting Hole
111 Nozzle
121*a* First Individual Ink Ejection Flow Path
121*b* Second Individual Ink Ejection Flow Path
122*a*, 122*b* Horizontal Individual Ejection Flow Path
123*a*, 123*b* Perpendicular Individual Ejection Flow Path
131 Pressure Chamber
132 Air Chamber
133*a* First Common Ink Ejection Flow Path
133*b* Second Common Ink Ejection Flow Path
134*a*, 134*b* Horizontal Common Ejection Flow Path
135*a*, 135*b* Perpendicular Common Ejection Flow Path
136 Partition
200 Inkjet Recording Apparatus
G1 Nozzle Group
G2 Nozzle Group
M Recording Medium
P1-P7 Pump
S1 First Flow-in Section
S2 Second Flow-in Section

What is claimed is:

1. An inkjet head comprising:

a plurality of ink discharge sections each comprising:

pressure chambers that store ink and change pressure on the stored ink;

nozzles communicating to the respective pressure chambers, through which ink is discharged according to the change of pressure on the ink in the pressure chambers; and first individual ink ejection flow paths and second individual ink ejection flow paths which communicate to the respective pressure chambers and through which ink is ejected from the pressure chambers without being supplied to the nozzles, wherein the nozzles are disposed at different positions in a predetermined direction;

a first common ink ejection flow path which communicates to the first individual ink ejection flow paths of the plurality of ink discharge sections and into which ink flows through the first individual ink ejection flow paths in a first flow-in section; and a second common ink ejection flow path which communicates to the second individual ink ejection flow paths of the plurality of ink discharge sections and into which ink flows through the second individual ink ejection flow paths in a second flow-in section, wherein the plurality of ink ejection sections are disposed in such a positional relation that, as a position of the nozzles of the plurality of ink discharge sections is nearer to a one end in the predetermined direction of an arrangement range of the nozzles of the plurality of ink discharge sections, a corresponding position at which ink ejected from the ink ejection sections flows in in the first flow-in section is nearer to the one end in the predetermined direction in the first flow-in section and a corresponding position at which ink ejected from the ink ejection sections flows in in the second flow-in section is nearer to the one end in the predetermined direction in the second flow-in section, wherein a first direction of ejection of ink in the first flow-in section of the first common ink ejection flow path has a component opposite to a second direction of ejection of ink in the second flow-in section of the second common ink ejection flow path.

2. The inkjet head according to claim 1, wherein the first direction of ejection and the second direction of ejection are opposite to one another.

3. The inkjet head according to claim 2, wherein at least one of the first common ink ejection flow path or the second common ink ejection flow path includes a plurality of common ink ejection flow paths, wherein the first common ink ejection flow path and the second common ink ejection flow path are alternately disposed in an orthogonal direction orthogonal to the first direction of ejection, wherein a nozzle group including two or more of the nozzles is disposed at each gap between the first common ink ejection flow path and the second common ink ejection flow path that are next to one another, in a view from a direction perpendicular to a nozzle opening surface on which openings of the nozzles are disposed, wherein, in the ink discharge sections with the nozzles in the nozzle group, the first individual ink ejection flow paths communicate to the first common ink ejection flow path nearest to the said nozzle group in the orthogonal direction, and the second individual ink ejection flow paths communicate to the second common ink ejection flow path nearest to the said nozzle group.

4. The inkjet head according to claim 3, wherein a minimum value of a cross-sectional area vertical to the first direction of ejection of the first flow-in section in the first common ink ejection flow path is greater as a number of the first individual ink ejection flow paths communicating to the first common ink ejection flow path is larger, wherein a minimum value of a cross-sectional area vertical to the second direction of ejection of the second flow-in section in the second common ink ejection flow path is greater as a number of the second individual ink ejection flow paths communicating to the second common ink ejection flow path is larger.

5. The inkjet head according to claim 1, comprising an ink ejection outlet through which ink is ejected to an outside, wherein the first common ink ejection flow path and the second common ink ejection flow path commonly communicate to the ink ejection outlet.

6. The inkjet head according to claim 1, wherein at least one of: the first flow-in section of the first common ink ejection flow path; or the second flow-in section of the second common ink ejection flow path has a cross-sectional area perpendicular to a direction of ejection of ink that is different at different positions in the direction of ejection.

7. The inkjet head according to claim 1, wherein a direction of ejection of ink is opposite to one another between the first individual ink ejection flow paths and the second individual ink ejection flow paths in each of the plurality of ink discharge sections.

8. An inkjet recording apparatus comprising the inkjet head according to claim 1.

9. The inkjet recording apparatus according to claim 8, comprising a first pressure controller that individually controls pressure on ink at a predetermined point on a downstream side from the first flow-in section in a direction of ejection of ink in the first common ink ejection flow path and pressure on ink at a predetermined point on a downstream side from the second flow-in section in a direction of ejection of ink in the second common ink ejection flow path.

10. The inkjet recording apparatus according to claim 8, comprising a second pressure controller that individually controls pressure on ink at a predetermined point on an upstream side from the first flow-in section in a direction of ejection of ink in the first common ink ejection flow path and pressure on ink at a predetermined point on an upstream side from the second flow-in section in a direction of ejection of ink in the second common ink ejection flow path.

* * * * *